US007004265B2

(12) United States Patent
Van Puymbroeck et al.

(10) Patent No.: US 7,004,265 B2
(45) Date of Patent: Feb. 28, 2006

(54) APPARATUS AND METHODS FOR SPONGE CORING

(75) Inventors: Luc Van Puymbroeck, Kingwood, TX (US); Bob T. Wilson, Dubai (AE); Holger Stibbe, Humble, TX (US); Hallvard S. Hatloy, Nienhagen (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/057,449

(22) Filed: Feb. 14, 2005

(65) Prior Publication Data

US 2005/0133275 A1 Jun. 23, 2005

Related U.S. Application Data

(62) Division of application No. 10/649,494, filed on Aug. 27, 2003, which is a division of application No. 09/712,473, filed on Nov. 14, 2000, now Pat. No. 6,719,070.

(51) Int. Cl.
*E21B 10/02* (2006.01)
*E21B 25/00* (2006.01)

(52) U.S. Cl. ..... 175/250; 175/20; 175/403

(58) Field of Classification Search ..... 166/153; 175/244, 249, 250, 251, 252, 253, 226, 59, 175/4, 20, 403
See application file for complete search history.

(56) References Cited

U.S. PATENT DOCUMENTS 1,857,693 A 5/1932 Quintrell
1,867,720 A * 7/1932 Wellensiek ..... 175/234
2,596,832 A * 5/1952 Williams, Jr. ..... 175/250
2,747,841 A * 5/1956 Murdoch et al. ..... 175/250
2,789,790 A 4/1957 Kirby, II
3,511,324 A 5/1970 Pieters et al.
3,986,555 A * 10/1976 Robertson ..... 175/246
4,142,594 A 3/1979 Thompson et al.
4,256,192 A 3/1981 Aumann
4,312,414 A 1/1982 Park
4,449,594 A 5/1984 Sparks
4,479,557 A 10/1984 Park et al.

(Continued)

FOREIGN PATENT DOCUMENTS

GB 2 000 824 A 1/1979

(Continued)

OTHER PUBLICATIONS

Sponge Coring, DBS Coring Services, 22 pp., 1993.

*Primary Examiner*—Jennifer H Gay
(74) *Attorney, Agent, or Firm*—TraskBritt

(57) ABSTRACT

A sponge core barrel for use in performing sponge coring and methods of assembling the sponge core barrel, as well as methods of performing sponge coring. The sponge core barrel includes an outer barrel assembly, a core bit secured to a lower end thereof, and an inner barrel assembly disposed therein. The inner barrel assembly may comprise multiple, sponge-lined inner tube sections and may also include a near-bit swivel assembly. The sponge core barrel may include a piston assembly configured to be released by contact with a core sample without imparting high compressive forces to the core. The sponge core barrel may also include a pressure compensation mechanism and, optionally, a thermal compensation mechanism cooperatively configured to maintain the pressure of presaturation fluid. The sponge core barrel may also include a valve assembly enabling the make-up and presaturation of multiple, sections of inner tube to form a single, continuous chamber.

13 Claims, 12 Drawing Sheets

U.S. PATENT DOCUMENTS 4,502,553 A 3/1985 Park et al.
4,566,545 A 1/1986 Story et al.
4,598,777 A 7/1986 Park et al.
4,638,872 A 1/1987 Park et al.
4,716,974 A 1/1988 Radford et al.
4,735,269 A 4/1988 Park et al.
4,787,983 A 11/1988 DiFoggio et al.
5,042,598 A 8/1991 Sherman
5,107,942 A 4/1992 Radford
5,253,720 A 10/1993 Radford et al.
5,255,751 A 10/1993 Stogner
5,360,074 A 11/1994 Collee et al.
5,439,065 A 8/1995 Georgi
5,482,123 A 1/1996 Collee
5,546,798 A 8/1996 Colee et al.
5,560,438 A 10/1996 Collee et al.
5,568,838 A 10/1996 Struthers et al.
5,881,825 A 3/1999 Collee et al.
6,009,960 A 1/2000 Leitko et al.
6,158,534 A * 12/2000 Fanuel ..... 175/403
6,164,389 A * 12/2000 Fanuel et al. ..... 175/20
6,216,804 B1 4/2001 Aumann et al.
6,230,825 B1 5/2001 Aumann et al.
6,305,482 B1 10/2001 Aumann et al.
6,378,631 B1 4/2002 Aumann et al.
2002/0033281 A1 * 3/2002 Aumann et al. ..... 175/244
2002/0139583 A1 * 10/2002 Masui et al. ..... 175/58

FOREIGN PATENT DOCUMENTS

WO WO 97/26439 * 7/1997

* cited by examiner

APPARATUS AND METHODS FOR SPONGE CORING

CROSS-REFERENCE TO RELATED APPLICATIONS

This application is a divisional of application Ser. No. 10/649,494, filed Aug. 27, 2003 which is a divisional of application Ser. No. 09/712,473, filed Nov. 14, 2000, now U.S. Pat. No. 6,719,070, issued Apr. 13, 2004.

BACKGROUND OF THE INVENTION

1. Field of the Invention

The present invention relates generally to apparatus and methods for taking core samples of subterranean formations. Specifically, the present invention relates to a sponge core barrel assembly, and methods of using the same, for obtaining a formation core sample while maintaining the structural and chemical integrity of the core sample for subsequent analysis.

2. State of the Art

Formation coring is a well-known process in the oil and gas industry. In conventional coring operations, a core barrel assembly is used to cut a cylindrical core from the subterranean formation and to transport the core to the surface for analysis. Analysis of the core can reveal invaluable data concerning subsurface geological formations and, particularly, hydrocarbon-bearing formations, including parameters such as permeability, porosity, and fluid saturation, which are useful in the exploration for petroleum, gas, and minerals. Such data may also be useful for construction site evaluation and in quarrying operations.

A conventional core barrel assembly typically includes an outer barrel assembly, a core bit, and an inner barrel assembly. Generally, a conventional outer barrel assembly comprises one or more hollow cylindrical sections, or "subs," which are typically secured end-to-end by threads. Secured to a lower end of the outer barrel assembly is the core bit, which is adapted to cut a cylindrical core and to receive the core in a central opening, or throat. The opposing upper end of the outer barrel assembly is attached to the end of a drill string, which conventionally comprises a plurality of tubular sections that extend to the surface. Disposed within the outer barrel assembly is the inner barrel assembly, which is configured to receive the core as the core traverses the throat of the core bit and to retain the core for subsequent transportation to the surface, is the inner barrel assembly.

The outer barrel assembly typically includes a swivel assembly disposed proximate an upper end thereof from which the inner barrel assembly is suspended, an upper end of the inner barrel assembly being releasably secured to the swivel assembly. The swivel assembly includes a thrust bearing or bearings enabling the core bit and outer barrel to rotate freely with respect to the inner barrel assembly suspended within. A conventional outer barrel assembly typically includes a safety joint disposed at its upper end proximate the drill string. If the core barrel assembly becomes wedged or jammed in a bore hole during coring, the safety joint enables the inner barrel assembly and core to be removed, while leaving the outer barrel assembly in the bore hole for subsequent retrieval. The outer barrel assembly may also include one or more sections including core barrel stabilizers that reinforce and stabilize the core barrel during coring, thereby reducing bending of the core barrel assembly and wobble of the core bit. A core barrel assembly may further include an outer tube sub having one or more wear ribs that function to reduce contact between the outer barrel assembly and the wall of the wellbore and, hence, wear of the outer barrel.

Conventional core bits are generally comprised of a bit body having a face surface on one end. The opposing end of the core bit is configured, as by threads, for connection to the lower end of the outer barrel assembly. Located at the center of the face surface is the throat, which extends into a hollow cylindrical cavity formed in the bit body. The face surface includes a plurality of cutters arranged in a selected pattern. The pattern of cutters includes at least one outside gage cutter disposed at the periphery of the face surface that determines the diameter of the bore hole drilled in the formation. The pattern of cutters also includes at least one inside gage cutter disposed adjacent and protruding within the diameter of the throat to determine the outside diameter of the core being cut as it enters the throat.

During coring operations, a drilling fluid is usually circulated through the core barrel assembly to lubricate and cool the plurality of cutters disposed on the face surface of the core bit and to remove formation cuttings from the bit face surface to be transported upwardly to the surface through an annulus defined between the drill string and the wall of the bore hole. A typical drilling fluid, or drilling mud, may include a hydrocarbon or water base or fluid carrier in which fine-grained mineral matter is suspended. The core bit usually includes one or more ports or nozzles positioned to deliver drilling fluid to the face surface. Generally, a port includes a port outlet at the face surface in fluid communication with a bore. The bore extends through the bit body and terminates at a port inlet. Each port inlet is in fluid communication with an annular region defined between the outer barrel assembly and the inner barrel assembly. Drilling fluid received from the drill string under pressure is circulated into the annular region, which enables the port inlet of each port to draw drilling fluid from the annular region. Drilling fluid then flows through each bore and discharges at its associated port outlet to lubricate and cool the plurality of cutters on the face surface and to remove formation cuttings as noted above.

Located within the outer barrel assembly, and releasably attached to the swivel assembly, is the inner barrel assembly. The inner barrel assembly includes an inner tube configured for retaining the core and a core shoe disposed at one end thereof adjacent the throat of the core bit. The core shoe is configured to receive the core as it enters the throat and to guide the core into the inner tube. A core catcher may be disposed proximate the core shoe to assist, in conjunction with the core shoe, in guiding the core into the inner tube and also to retain the core within the inner tube. Thus, as the core is cut—by application of weight to the core bit through the outer barrel assembly and drill string in conjunction with rotation of these components—the core will traverse the throat of the core bit to eventually reach the rotationally stationary core shoe, which accepts the core and guides it into the inner tube where the core is retained until transported to the surface for examination.

Disposed proximate the upper end of the inner barrel assembly where the inner barrel assembly joins to the swivel assembly is a pressure relief plug. The pressure relief plug allows drilling fluid to circulate through the inner tube to flush the inner tube and to clean the bottom of the bore hole prior to coring. To commence coring, a drop ball is seated in the pressure relief plug to divert drilling fluid away from the inner tube and into the annular region between the outer and inner barrels. As the core enters the inner tube, the pressure relief plug also functions to relieve pressure within the inner tube.

The discharge of drilling fluid from the port outlets at the face surface of a core bit during a coring operation may result in drilling fluid invasion of the core. Drilling fluid invasion may result from any one of a number of conditions, or a combination thereof. Drilling fluid discharged at the face surface of the core bit may, if not appropriately directed radially outward away from the core, flow towards the core being cut where the drilling fluid can then contact the core. Also, in most conventional core bits, a narrow annulus exists in a region bounded by the inside diameter of the bit body and the outside diameter of the core shoe, this narrow annulus essentially being an extension of the annular region and terminating at an annular gap proximate the entrance to the core shoe near the throat of the core bit. Pressurized drilling fluid circulating in the annular region may, in addition to flowing into the port inlets, flow into the narrow annulus and out through the annular gap to be discharged proximate the throat of the core bit. This drilling fluid entering the narrow annulus and exiting the annular gap proximate the throat of the core bit, referred to as "flow split," can contact the core being cut as the core traverses the throat and enters the core shoe. Further, a low rate of penetration ("ROP") through the formation being cored can lead to drilling fluid invasion of the core as the exposure time of the core to drilling fluids is unduly prolonged.

Drilling fluid invasion can cause a number of deleterious effects, including flushing of reservoir fluids from the core and chemical alteration of the properties of the reservoir fluids. Flushing and chemical alteration of the reservoir fluids in the core can inhibit core analysis and prevent the acquisition of reliable formation data, especially fluid saturation properties such as oil and water saturation. As a result of drilling fluid invasion, it may also be difficult to obtain reliable data for other formation characteristics, such as permeability and wettability.

Another significant factor that may inhibit the acquisition of reliable formation fluid saturation data is reservoir gas expansion resulting from a large pressure differential between the bottom of the bore hole and the surface. As a core sample is raised to the surface from the bottom of the bore hole, where the pressure may be relatively high, gases entrained within the core sample will expand and migrate out of the core sample. The expansion and migration of reservoir gases from the core sample often cause reservoir fluids contained within the core sample to be expelled. The expelled reservoir fluids are difficult, if not impossible, to recover and, therefore, the reliable measurement of fluid saturation properties is impeded.

One conventional approach to preserving the integrity of the core and obtaining reliable formation data, especially reservoir fluid properties such as oil and water saturation, is sponge coring. Sponge coring is performed using a "sponge core barrel." Generally, a sponge core barrel comprises a conventional core barrel assembly, as was described above, that has been adapted for use with a plurality of sponge liners. Each sponge liner includes a layer of absorbent material selected for its ability to absorb the reservoir fluid of interest (for example, oil) from a core sample.

A conventional sponge liner comprises an annular sponge layer encased in a tubular sleeve. The annular sponge layer is constructed of a material adapted to absorb a specified reservoir fluid of interest. For example, if the particular formation characteristic of interest is oil saturation, the sponge layer is constructed of an oil-absorptive material such as polyurethane. To obtain formation water saturation data, a water-absorptive material is used to construct the sponge layer. A common water-absorptive material used for the construction of the sponge layer is a cellulose fiber and polyurethane composite.

The tubular sleeve provides structural support for the annular sponge layer and is typically constructed of a relatively rigid material such as aluminum. The annular sponge layer is adhered to the interior cylindrical surface of the sleeve, which may include a plurality of ribs extending radially inward therefrom. The ribs provide additional structural support for the sponge layer and also provide additional surface area to which the sponge layer may adhere. However, even with the addition of radially extending ribs, the annular sponge layer may separate or peel away from the surfaces of the ribs and the cylindrical interior of the tubular sleeve during coring. Also, the tubular sleeve may include a plurality of holes or other perforations to compensate for expansion of formation gases, as will be described below.

The inner barrel assembly of a sponge core barrel includes an inner tube adapted to receive the plurality of sponge liners, the inner diameter of the inner tube being substantially equal to the outer diameter of a sponge liner. During a coring operation, a core shoe disposed at the lower end of the inner tube guides the core being cut into the inner tube and sponge liners disposed therein, where the core is retained for subsequent transportation to the surface and later analysis. The cylindrical interior cavity of the annular sponge layer is of a diameter substantially equal to the diameter of the core being cut, such that the interior cylindrical surface of the annular sponge layer substantially continuously contacts the exterior surface of the core. The substantially continuous contact between the annular sponge layer and the core often results in the application of significant frictional forces on the core.

When the inner barrel assembly and core are raised to the surface, where the ambient pressure may be significantly less than the downhole pressure, formation gases within the core sample may expand and expel reservoir fluids from the core. The expelled reservoir fluids are then absorbed by the annular sponge layer and preserved for later analysis, rather than separating from the core sample and flowing out, as by gravity, from the inner tube. The perforations in the sleeve of the sponge liner allow reservoir gases to escape. Also, because the sponge layer contacts the core and is relatively flexible as compared to the core, the sponge liners serve to contain the core and protect the core from mechanical damage.

Sponge liners are typically supplied in standard 5-ft or 6-ft sections, a number of which are placed end-to-end within the inner tube to substantially fill the length, (usually a standard 30 feet) of the inner tube. The inner tube is typically constructed of a steel material and, as indicated above, the tubular sleeve of a conventional sponge liner comprises an aluminum material. Due to the differences in material properties of the tubular sleeve and the inner tube, the coefficient of thermal expansion for aluminum is approximately twice that of steel, and the long extent of the inner tube and sponge liners disposed end-to-end therein, the conventional sponge core barrel assembly routinely experiences differential thermal expansion. Differential thermal expansion between the inner tube and sponge liners may occur longitudinally along the length of the inner tube as well as radially. Differential thermal expansion may cause mechanical damage to components of the sponge core barrel assembly and may also damage the core sample.

Differential thermal expansion between the inner barrel assembly and the outer barrel assembly may also be present. The various components making up the outer barrel assembly are usually constructed of one or more types of alloy steel. Although the inner tube sections are typically constructed of a steel material, as noted above, it may be desirable to construct the inner tube sections from other suitable materials, such as aluminum and composite materials. If the outer barrel assembly and inner barrel assembly are constructed of materials exhibiting significantly different thermal expansion characteristics, differential thermal expansion between the outer and inner barrel assemblies will result. Differential thermal expansion between the outer barrel assembly and the inner barrel assembly can cause a number of problems during coring. Specifically, such differential thermal expansion can cause mechanical damage to the core barrel and may result in additional drilling fluid invasion due to increased flow split.

As noted above, flow split is the result of the flow of drilling fluid from the annular region between the inner and outer barrel assemblies and through a narrow annulus that exists between the bit body and the core shoe, to be exhausted through an annular gap near the throat of the core bit and proximate the core sample. The annular gap is defined by a longitudinal distance between the lower end of the core shoe and the bit body. The width of the annular gap—and, hence, the volume of flow split—is a function of the difference between the longitudinal length of the outer barrel assembly and the longitudinal length of the inner barrel assembly; the inner barrel assembly being suspended at its upper end from a swivel assembly disposed proximate the upper end of the outer barrel assembly. Although the provision of a narrow annulus and annular gap may result in flow split, the narrow annulus and annular gap are necessary as the clearance between the core shoe and the bit body provided by the narrow annulus and annular gap enables the outer barrel assembly and core bit to rotate freely relative to the inner barrel assembly. Thus, it is desirable to maintain the width of the annular gap at a controlled, minimum distance.

Conventionally, in order to maintain the width of the annular gap at a specified value in lieu of differential thermal expansion between the inner and outer barrel assemblies, the magnitude of the differential thermal expansion is calculated based on an estimated or known downhole temperature and an adjustment is made based on this calculated value. Typically, the adjustment comprises leaving a large spacing between the end of the inner barrel assembly (i.e., the core shoe) and the lower end of the outer barrel assembly (i.e., the bit body), the large spacing being closed by differential thermal expansion between the inner and outer barrel assemblies. However, this method of compensating for differential thermal expansion between the inner and outer barrel assemblies is prone to human error and is susceptible to unexpected downhole temperature swings.

In conventional sponge coring operations, in order to protect the sponge liners from drilling fluid contamination prior to commencement of coring and from being compressed as a result of high downhole pressure, the inner tube is evacuated and filled with a presaturation fluid. The presaturation fluid is selected such that it will not be absorbed by the annular sponge layer, i.e., the presaturation fluid comprises a base fluid that exhibits characteristics opposite to those of the reservoir fluid being measured. For example, if oil saturation data is required, the presaturation fluid may include water as the base fluid. Presaturation usually occurs on the floor of the drilling rig after an inner barrel is assembled. A valve disposed at the upper end of the inner tube enables the evacuation of the inner tube and the subsequent pumping of presaturation fluid into the inner tube.

Containment of the presaturation fluid within the inner tube prior to entry of the core is provided by a sealing mechanism disposed at the lower end of the inner tube proximate the core bit. The sealing mechanism must be capable of retaining the presaturation fluid under pressure within the inner tube prior to commencement of coring and, further, must enable the presaturation fluid to flow out of the inner tube upon entry of the core into the inner tube. The sealing mechanism also prevents the entry of drilling fluid into the inner tube from the throat of the core bit. A number of sealing mechanisms for use in sponge coring operations are known in the art.

Disclosed in U.S. Pat. No. 4,598,777 to Park et al. is a piston seal assembly comprising a piston disposed at the lower end of an inner tube and an O-ring providing a fluid seal between the piston and the interior wall of the inner tube. Prior to coring, the piston remains at the lower end of the inner tube to retain the presaturation fluid within the inner tube and to prevent ingress of drilling fluids into the inner tube. When coring begins, the core traverses the throat of the core bit and contacts the lower end of the piston, dislodging the piston and pushing the piston upwardly into the inner tube. As the piston begins to move upwardly, the fluid seal provided by the O-ring is broken, allowing presaturation fluid to flow around the piston and out through the lower end of the inner tube and the throat of the core bit. Due to thermal expansion of the presaturation fluid and to compression of the sponge core barrel resulting from high downhole pressure, the presaturation fluid within the inner tube may exhibit a high pressure prior to coring. To break the fluid seal and dislodge the piston, the core must overcome forces resulting from this high pressure, as well as any frictional forces generated between the O-ring and the interior wall of the inner tube. Large compressive forces may be applied to the end of the core in overcoming the high pressure exerted on the piston and any frictional forces, which may cause structural damage to the core.

U.S. Pat. No. 4,479,557 to Park et al. discloses a seal mechanism comprising a diaphragm and a piercer. The diaphragm comprises a rupturable membrane positioned at the lower end of the inner tube that, prior to being ruptured, is capable of retaining presaturation fluid within the inner tube and inhibiting the flow of drilling fluid thereinto. The piercer comprises a piston movable through the inner tube having a lower, planar end configured for contacting the core and an opposing, conical end configured for piercing the diaphragm. As a core is cut and enters the throat of the core bit, the core contacts the lower end of the piercer and pushes the piercer upwardly through the inner tube. The apex of the piercer then contacts and ruptures the diaphragm, enabling some presaturation fluid to flow out around the piercer while the remainder of the presaturation fluid is forced out through a check valve at the upper end of the inner tube as the piercer and core traverse the inner tube. Again, however, the presaturation fluid may be subject to high pressure prior to the commencement of coring and, as a result, high compressive forces may be exerted on the core during rupturing of the diaphragm.

As suggested above, a conventional assembled sponge core barrel comprises a standard 30-ft outer barrel assembly having a core bit secured to a lower end thereof. Disposed within the outer barrel assembly, and rotationally suspended from a swivel assembly, is a standard 30-ft inner barrel assembly. The inner barrel assembly includes an inner tube with a plurality of 5-ft or 6-ft sponge liners disposed end-to-end therein. The inner barrel is assembled on the drilling rig floor and is subsequently evacuated and filled with presaturation fluid prior to being picked up and lowered into the outer barrel assembly, which is suspended from the rig floor. Use of a 30-ft sponge core barrel assembly, however, inherently limits the efficiency of sponge coring operations. The sponge core barrel assembly must be raised from the bore hole when the maximum length of core has been retrieved inside the inner barrel, such that the core sample can be removed from the inner barrel assembly and new sponge liners inserted. Raising, or tripping, of a drill string from the bore hole is a time-consuming operation and, therefore, it is desirable to core with core barrels greater than 30 feet in length.

Conventional coring operations—not including conventional sponge coring—are routinely performed using core barrel lengths of 60 feet, 90 feet, 120 feet, or longer. Make up of the outer barrel assembly typically comprises interconnecting the various components of the outer barrel assembly while suspending the outer barrel through the floor of the drilling rig. In other words, each component of the outer barrel assembly is individually or, in conjunction with other attached components, lifted off the rig floor and secured to the partially assembled outer barrel (i.e., those components already assembled), which is suspended from the rig floor. Subsequently, the inner barrel assembly is rigged up section-by-section within the outer barrel assembly, interconnections between the inner barrel sections being made just above the upper end of the outer barrel assembly. The inner barrel assembly is then secured to a swivel assembly that is attached to the outer barrel assembly, the swivel assembly rotationally isolating the inner barrel assembly from the outer barrel assembly.

By way of example, 90-ft outer barrel assembly having a core bit secured to a lower end thereof may be rigged up and suspended through the rig floor. A first 30-ft section of inner barrel having a core shoe at a lower end thereof is then lowered into the outer barrel assembly, a portion of the upper end of the first inner barrel section extending above the outer barrel assembly. Next, a second 30-ft section of inner barrel is lifted off the rig floor and a lower end thereof is connected to the upper end of the first inner barrel section, the first and second inner barrel sections then being lowered into the outer barrel assembly with a portion of the upper end of the second inner barrel section extending above the outer barrel assembly. A third 30-ft section of inner barrel is then lifted off the rig floor and a lower end of this third section is connected to the upper end of the second inner barrel section. The first, second, and third interconnected inner barrel sections are then lowered into the outer barrel assembly. Additional components may be secured to the upper end of the third inner barrel section, such as a pressure relief plug and drop ball. The first, second, and third inner barrel sections—the inner barrel assembly—is then secured to a swivel assembly that is attached to the outer barrel assembly. The upper end of the outer barrel assembly is subsequently secured to the lower end of a drill string for coring.

During make up of the inner barrel assembly, a section of inner tube, or two or more interconnected inner tube sections, may be stored in a mouse hole prior to being hoisted above the outer barrel assembly for assembly and insertion thereinto. A mouse hole is an opening extending through and below the rig floor into which one or more inner tube sections (as well as outer barrel components) may be temporarily placed for make up and subsequent transfer to the outer barrel assembly. Offshore drilling rigs commonly have a mouse hole extending to a depth of 60 feet or more below the rig floor.

It would be desirable to conduct sponge coring operations with a core barrel assembly greater than 30 feet in length, i.e., using a 60-ft, 90-ft, 120-ft or other desired extended-length core barrel comprised of multiple 30-ft (or some other suitable length) sections of inner barrel, such as is routinely performed in conventional coring operations, as noted above. However, to present day, it has been thought impossible to conduct sponge coring operations with extended-length core barrels, i.e., one having a length greater than 30-feet, due to a number of technical difficulties. Specifically, frictional forces generated between a core and a sponge-lined inner barrel increase as a function of length of the sponge-lined inner barrel, and high frictional forces can adversely affect the mechanical integrity of the core, as well as cause damage to the sponge material. Thus, for sponge-lined inner barrels longer than the conventional 30 feet, it has been believed that, without significant improvements of the sponge material, extreme frictional forces would be generated between the sponge materials, such extreme frictional forces leading to core damage and structural failure of the sponge material. Also, differential thermal expansion and resultant problems, as noted above, become more pronounced with increasing length of the core barrel assembly. Further, suitable methods and apparatus for performing sponge coring with extended-length core barrels are presently unavailable. For example, methods and apparatus for separately presaturating and subsequently interconnecting individual sections of inner tube were heretofore unknown.

Thus, a need exists in the art of subterranean formation coring for apparatus and methods for performing sponge coring that overcome the limitations of the prior art. Specifically, a need exists for a sponge core barrel assembly having an inner barrel assembly adapted to control the presaturation fluid pressure and further including an easily actuated sealing mechanism, such that damage to the core during depressurization and release of the presaturation fluid is eliminated. A need also exists for a sponge core barrel assembly comprised of multiple inner barrel sections and having a length greater than the conventional 30 feet. Yet another need exists for a sponge core barrel assembly adapted to compensate for differential thermal expansion between the inner tube and one or more sponge liners, as well as adapted to compensate for differential thermal expansion between the outer barrel assembly and the inner barrel assembly. Further, a need exists for a high-strength sponge liner resistant to debonding of the sponge layer from the surrounding sleeve, and a need exists for such a sponge liner that imparts minimal frictional forces to the core.

BRIEF SUMMARY OF THE INVENTION

The present invention comprises a sponge core barrel in various embodiments for use in performing sponge coring. A sponge core barrel assembly generally includes an outer barrel assembly having a core bit secured to a lower end thereof, an opposing upper end of the outer barrel assembly being configured for connection to a drill string. Disposed within the outer barrel assembly is an inner barrel assembly, which may be suspended at an upper end thereof from a swivel assembly located proximate the upper end of the outer barrel assembly, the swivel assembly enabling the outer barrel assembly to rotate freely relative to the inner barrel assembly. The inner barrel assembly includes a core shoe at a lower end thereof configured for receiving a core sample from a throat of the core bit and for guiding the core sample into the inner barrel assembly. The inner barrel assembly further includes one or more sponge liners disposed therein, each sponge liner having a sponge material adapted to readily absorb the reservoir fluid of interest.

In one embodiment of the present invention, the sponge liner or liners disposed in the inner barrel assembly include an annular sponge layer secured within the interior cylindrical surface of a tubular sleeve. One or more grooves are formed or machined into the interior cylindrical surface of the tubular sleeve, and the annular sponge layer extends into the groove or grooves to secure the annular sponge layer to the tubular sleeve. The groove or grooves may be oriented longitudinally or circumferentially, or form a helix or spiral along the interior cylindrical surface of the tubular sleeve. Further, the groove or grooves may be of any suitable cross-sectional shape, such as a dove-tail, for enhanced securement of the sponge layer material.

In another embodiment, a webbing layer of any suitable pattern or configuration may be immersed within, or molded into, the annular sponge layer, the webbing layer being positioned within the radial thickness of the annular sponge layer at any suitable location. The webbing layer provides further structural support for the annular sponge layer, prevents gouging of the annular sponge layer by a core sample, inhibits peeling of the annular sponge layer from the tubular sleeve, provides additional mechanical support for the core sample during transportation, and reduces friction between the core sample and the annular sponge layer.

The sponge liners may be provided in conventional 5-ft or 6-ft lengths which are stacked end-to-end within the inner barrel assembly, or within each section of inner tube making up the inner barrel assembly. In another embodiment of the present invention, however, a sponge liner is provided in a length substantially equivalent to the length of the inner barrel assembly, or substantially equivalent in length to the length of each inner tube section making up a multi-section inner barrel assembly.

In yet another embodiment of the present invention, the inner barrel assembly is comprised of one or more sponge-lined inner tube sections, or integrated sponge barrels. An integrated sponge barrel comprises an inner tube section directly encasing an annular layer of sponge material. Because an integrated sponge barrel has only a single outer material layer comprised of the inner tube section, and does not include a sleeve constructed from a first material surrounding the sponge material that is encased within an inner tube constructed of a second material, differential thermal expansion between the inner barrel assembly and the sponge liner or liners is eliminated. In a further embodiment of the invention, the inner barrel assembly or the sections of inner tube comprising the inner barrel assembly and the sleeve of the sponge liner or liners disposed therein are constructed of the same or similar materials, thereby substantially reducing differential thermal expansion therebetween.

In another embodiment of the present invention, longitudinally adjacent or facing ends of two adjacent sponge liners are configured to form an interlocking end-to-end connection. The interlocking end-to-end connection is provided by generally non-transverse (to a longitudinal axis of the core barrel) and closely mating contours on the facing ends, respectively, of the adjacent sponge liners. The interlocking end-to-end connection centers the adjacent sponge liners relative to one another and prevents the formation of a gap between the ends thereof, such a gap potentially creating a collection point for debris or providing a surface or edge for snagging a leading end of a core sample moving upwardly into the inner barrel assembly.

A further embodiment of the present invention includes a piston assembly configured to provide a fluid seal proximate the lower end of the inner barrel assembly for retaining presaturation fluid under pressure within the inner barrel assembly. The piston assembly comprises a cylindrical piston having a central bore therethrough and a piston rod slidably disposed within the central bore. The piston assembly may also include a seal, such as an O-ring type seal, disposed between the interior wall of the inner barrel assembly and the cylindrical piston and providing a fluid seal therebetween. The piston assembly further includes one or more locking elements disposed about the circumference of the piston and radially extendable and retractable therethrough. In a radially outermost position, each locking element is configured to engage an annular groove in the interior wall of the inner barrel assembly, securing or locking the piston assembly at a fixed longitudinal position near the lower end of the inner barrel assembly above the throat of the core bit.

In its lowermost position, the outer cylindrical surface of the piston rod is configured to abut the locking element or elements and to maintain the locking elements in their outermost radial position. A lower end of the piston rod may be configured as a disk-shaped portion having a lower planar surface for contacting a core as the core traverses the throat of the core bit. Upon contact with the core and further travel of the core into the inner barrel assembly, the core will compress the piston rod into the piston. The piston rod is configured such that, at full compression within the piston, the locking element or elements may be retracted and the piston released. The piston, locking element or elements, and piston rod are cooperatively configured to mechanically isolate the piston rod from the piston, thereby reducing resistance to travel of the piston rod through the piston.

The piston assembly further includes a plurality of ports or bores cooperatively configured to provide a fluid passageway through the piston assembly coincident with, or just prior to, release of the piston. Any presaturation fluid retained in the inner barrel assembly above the piston is, therefore, released prior to movement of the piston by the upwardly traveling core. The relief of fluid pressure ahead of the piston and the mechanical isolation of the piston rod, in conjunction with other features of the invention, reduce compressive forces on the core sample during release of the piston.

Another embodiment of the present invention comprises a pressure-compensated inner barrel assembly. The pressure compensation may be provided by a pressure compensation mechanism, a thermal compensation mechanism, or a combination thereof. The pressure compensation mechanism comprises a housing movable through the inner barrel assembly and providing a fluid seal therebetween. The housing further includes a pressure relief element configured to open and release presaturation fluid from the inner barrel assembly when the fluid pressure therein achieves a specified threshold.

The pressure compensation mechanism may be mechanically coupled to the thermal compensation mechanism. The thermal compensation mechanism may comprise an adjusting sleeve disposed between the housing of the pressure compensation mechanism and the top end of the sponge liner (or uppermost sponge liner, if more than one) disposed in the inner barrel assembly. Differential thermal expansion between the sponge liner or liners and the inner barrel assembly will result in longitudinal movement of the adjusting sleeve through the inner barrel assembly and, hence, corresponding longitudinal movement of the attached pressure compensation mechanism. Thus, as the downhole temperature increases and the sponge liners and inner barrel assembly, as well as any presaturation fluid disposed therein, thermally expand, the thermal compensation mechanism provides a corresponding upward movement of the housing of the pressure compensation mechanism, thereby expanding the volume available within the inner barrel assembly for containing the presaturation fluid. Accordingly, the pressure compensation and thermal compensation mechanisms are cooperatively configured to maintain the presaturation fluid within the inner barrel assembly at or below a specified threshold pressure.

A further embodiment of the invention comprises an inner barrel assembly made up of multiple, sponge-lined inner tube sections and providing a single continuous chamber for receiving a core sample. The multiple inner tube sections may be interconnected on the drilling rig floor and the single continuous chamber of the inner barrel assembly may then be filled with presaturation fluid. In an alternative embodiment, the individual inner tube sections may be sealed and separately filled with presaturation fluid. The individual presaturated inner tube sections are then interconnected to form an inner barrel assembly having the single continuous chamber.

Yet a further embodiment of the present invention comprises a valve assembly enabling the make up and presaturation of multiple, individual sections of inner tube and the subsequent interconnection of the individual sections within the outer barrel assembly to form an inner barrel assembly having a single, continuous internal chamber for containing presaturation fluid and for retaining a core sample. The valve assembly includes a lower seal assembly secured to the upper end of a first inner tube section and an upper seal assembly secured to the lower end of a second inner tube section that is to be secured end-to-end with the first inner tube section. Each of the lower and upper seal assemblies includes a seal element, such as a diaphragm, ball valve, or releasable piston that is configured to be opened upon joining of the lower seal assembly to the upper seal assembly.

The first inner tube section may be made-up on the floor of a drilling rig, with the lower seal assembly providing a fluid seal at an upper end thereof and a piston assembly according to the invention (or, optionally, the upper seal assembly of another valve assembly) providing a fluid seal at a lower end thereof. The first inner tube section may then be individually filled with presaturation fluid, lifted off the floor of the drilling rig, and inserted into the outer barrel assembly, which is suspended through the rig floor. The second inner tube section may then be made-up on the rig floor, with the upper seal assembly providing a fluid seal at a lower end thereof and the pressure compensation mechanism (or, optionally, the lower seal assembly of yet another valve assembly) providing a fluid seal at an upper end thereof. The second inner tube section may then be individually filled with presaturation fluid, lifted off the rig floor, and connected to the first inner tube section; the first and second inner tube sections are then further lowered into the outer barrel assembly. Interconnection of the first and second inner tube sections comprises securing the upper and lower seal assemblies to one another and opening the seal element of each seal assembly, thereby forming an inner barrel assembly having a single, continuous chamber filled with presaturation fluid. Any suitable number of inner tube sections and valve assemblies according to the invention may be used to fabricate an inner barrel assembly.

Another embodiment of the present invention comprises a swivel assembly disposed proximate or within the core bit, or a "near-bit" swivel assembly. The near-bit swivel assembly may include a radial bearing assembly configured to maintain the inner barrel assembly in the proper radial position and orientation relative to the outer barrel assembly and may further include a thrust bearing assembly configured, in conjunction with a shoulder and a latch mechanism disposed on the interior wall of the core bit, to maintain the inner barrel assembly in the proper longitudinal position and orientation with respect to the outer barrel assembly. The near-bit swivel assembly supports the inner barrel assembly within the outer barrel assembly and enables the outer barrel assembly to rotate freely relative to the inner barrel assembly. Because the near-bit swivel assembly is disposed at the core bit and no other swivel assembly is necessary at an upper end of the inner barrel assembly, the upper end of the inner barrel assembly is longitudinally floating within the outer barrel assembly and, accordingly, the upper end of the inner barrel assembly is allowed to freely thermally expand through the outer barrel assembly.

The scope of the present invention also encompasses methods of assembling core barrels for use in sponge coring operations, as well as methods for performing sponge coring.

BRIEF DESCRIPTION OF THE SEVERAL VIEWS OF THE DRAWINGS

While the specification concludes with claims particularly pointing out and distinctly claiming that which is regarded as the present invention, the features and advantages of this invention can be more readily ascertained from the following detailed description of the invention when read in conjunction with the accompanying drawings, in which:

DETAILED DESCRIPTION OF THE INVENTION

FIGS. 1A through 13 show various components of a sponge core barrel assembly according to the present invention. Like components, as well as specific features thereof, are identified throughout FIGS. 1A through 13 using the same numeric designation.

Figures 1A, 1B, 1C:
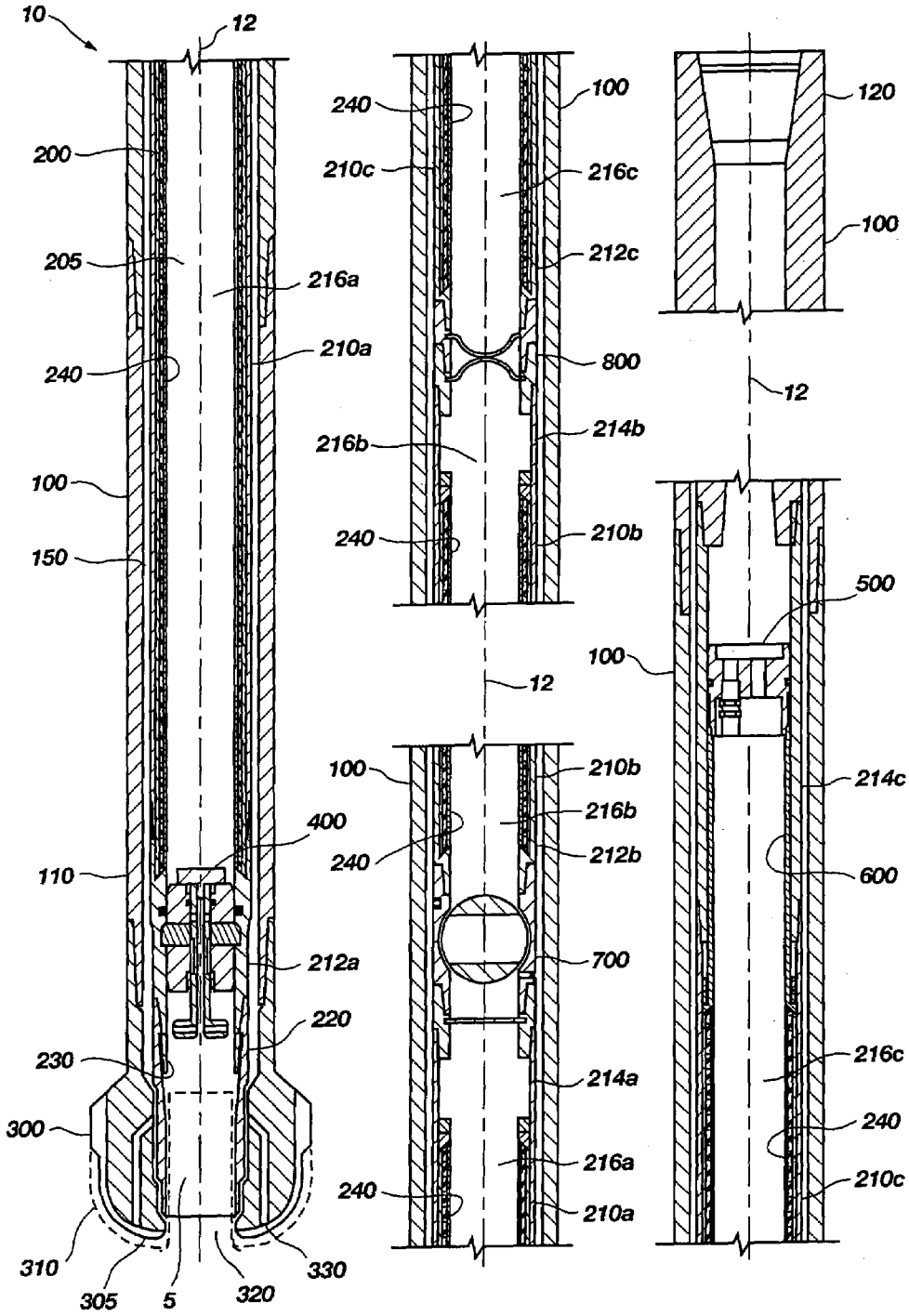
FIGS. 1A–1C show a partial, expanded cross-sectional view of a sponge core barrel assembly according to the present invention.

Shown in FIGS. 1A–1C is an exemplary embodiment of a sponge core barrel assembly 10 according to the present invention. The sponge core barrel assembly 10 has a longitudinal axis 12 and includes an outer barrel assembly 100 and a core bit 300 secured, as by threads, to the lower end 110 of the outer barrel assembly 100. The upper end 120 of the outer barrel assembly 100 is configured for connection to a drill string (not shown). Disposed within the outer barrel assembly 100 is an inner barrel assembly 200. The inner barrel assembly 200 is suspended from, for example, a swivel assembly (not shown) and rotates freely relative to the outer barrel assembly 100. In addition to the swivel assembly, the sponge core barrel assembly 10 may include any of a number of conventional core barrel components known in the art, which are not shown in FIGS. 1A through 13 for clarity. By way of example, the sponge core barrel assembly 10 may include a safety joint, one or more subs having a plurality of core barrel stabilizers, one or more outer tube subs having a plurality of wear ribs, or a drop ball and corresponding pressure relief plug.

The core bit 300 may be any suitable core bit as known in the art. Generally, the core bit 300 will include a plurality of cutters 310 arranged in a specified pattern across the face surface 305 of the core bit 300. In FIGS. 1A–1C and 7, a lateral or radial overlap or superimposition of the plurality of cutters 310 along the profile of the face surface 305 is shown by a dashed line, and individual cutting elements are not shown. At the face surface 305 is a central opening, or throat 320, extending into a central cavity within the core bit 300. As a core sample 5 (shown in dashed line) is cut from the formation, the core sample 5 will traverse the throat 320 of the core bit 300 and enter the inner barrel assembly 200, which extends into the central cavity of the core bit 300. Also, a plurality of ports 330 is disposed on the face surface 305 of the core bit 300, each port 330 being configured to deliver drilling fluid to the face surface 305 for lubricating the plurality of cutters 310. Drilling fluid is supplied to the plurality of ports 330 via an annular region 150 located between the outer barrel assembly 100 and the inner barrel assembly 200.

The inner barrel assembly 200 comprises a plurality of inner tube sections. The exemplary embodiments shown in FIGS. 1A–1C, 7, 8, 9, 10, 11, 12A–12C, and 13 each include three inner tube sections 210*a*, 210*b*, 210*c*; however, the present invention is not so limited and those of ordinary skill in the art will appreciate that the inner barrel assembly 200 may include any suitable number of inner barrel sections. Each inner tube section 210*a*, 210*b*, 210*c* has a specified length, typically 30 feet. The inner tube sections 210*a*, 210*b*, 210*c* may, however, be of any suitable length, such as, for example, 45 feet or 60 feet.

A core shoe 220 is secured to a lower end 212*a* of the lowermost inner tube section 210*a*. During coring, as the core sample 5 traverses the throat 320 of the core bit 300, the core shoe 220 functions to receive the core sample 5 and to guide the core sample 5 into the inner barrel assembly 200, where the core sample 5 is retained for subsequent transportation to the surface. A core catcher 230 may also be disposed proximate the lower end 212*a* of the lowermost inner tube section 210*a*; the core catcher 230 also serving to guide the core sample 5 into the inner barrel assembly 200 and, further, functioning to retain the core sample 5 within the inner barrel assembly 200.

Disposed within each inner tube section 210*a*, 210*b*, 210*c* are one or more sponge liners 240. If more than one sponge liner 240 is used in each inner tube section 210*a*, 210*b*, 210*c*, the sponge liners 240 are stacked end-to-end within each inner tube section 210*a*, 210*b*, 210*c* extending substantially the length thereof. As will be described in greater detail below, each sponge liner 240 includes at least a layer of absorbent material, the specific absorbent material employed being a function of the fluid saturation data to be measured.

Located proximate the lower end 212*a* of the lowermost inner tube section 210*a* is a piston assembly 400. Disposed between the upper end 214*a* of the lowermost inner tube section 210*a* and the lower end 212*b* of the intermediate inner tube section 210*b* is a first embodiment of a valve assembly 700, and disposed between the upper end 214*b* of the intermediate inner tube section 210*b* and the lower end 212*c* of the uppermost inner tube section 210*c* is a second embodiment of a valve assembly 800. Positioned near the upper end 214*c* of the uppermost inner tube section 210*c* is a pressure compensation mechanism 500 and a thermal compensation mechanism 600. The operation of the piston assembly 400, pressure compensation mechanism 500, thermal compensation mechanism 600, valve assembly 700, and valve assembly 800 will be explained in greater detail below.

Located within the lowermost inner tube section 210*a* between the piston assembly 400 and the valve assembly 700 is a chamber 216*a*. Similarly, within the intermediate inner tube section 210*b* between the valve assembly 700 and the valve assembly 800 is a chamber 216*b*, and within the uppermost inner tube section 210*c* between the valve assembly 800 and the pressure compensation mechanism 500 is a chamber 216*c*. As will be explained in greater detail below, the chambers 216*a*, 216*b*, 216*c* may be combined to form a single chamber 205 extending substantially the length of the inner barrel assembly 200 for receiving and containing presaturation fluid under pressure. The piston assembly 400 provides a seal at a lower end of the chamber 205 and the pressure compensation mechanism 500 provides a movable seal at an upper end of the chamber 205, the movable seal enabling the internal volume of chamber 205 to expand. Piston assembly 400, pressure compensation mechanism 500, and thermal compensation mechanism 600 are cooperatively configured to provide a pressure compensated (i.e., a substantially controlled maximum pressure relative to a pressure outside the inner barrel assembly 200) chamber 205 for presaturation fluid within the inner barrel assembly 200.

Figure 3:
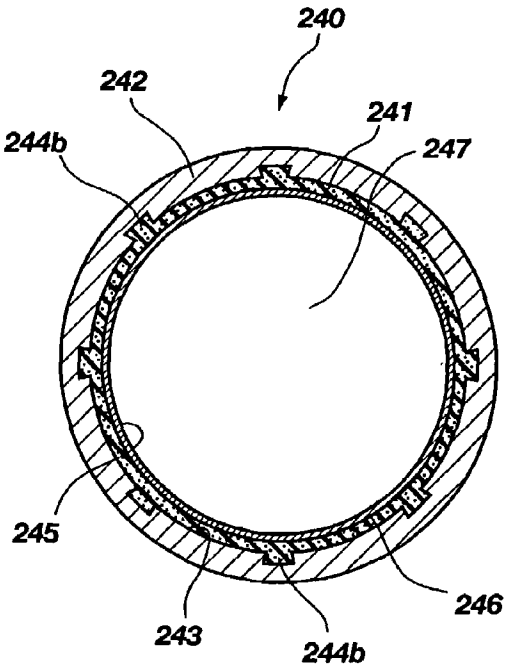
FIG. 3 is a cross-sectional view of the sponge liner as taken along line 3—3 of FIG. 2.
Figure 2:
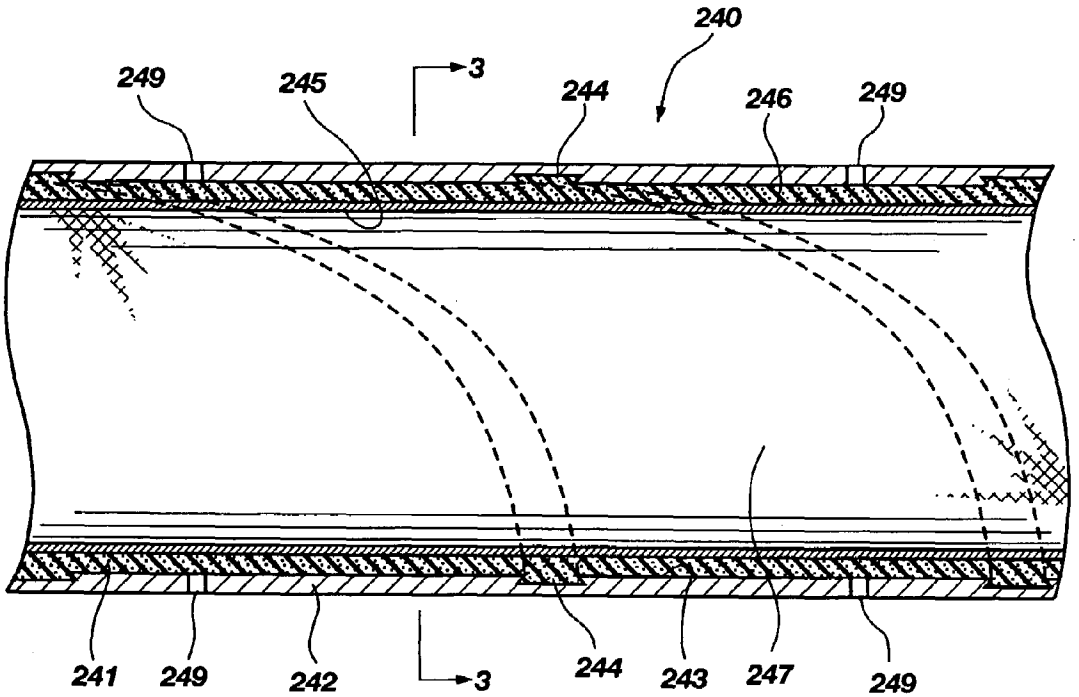
FIG. 2 is a cross-sectional view of a portion of a sponge liner according to the present invention, as shown in FIGS. 1A–1C.
Figure 4:
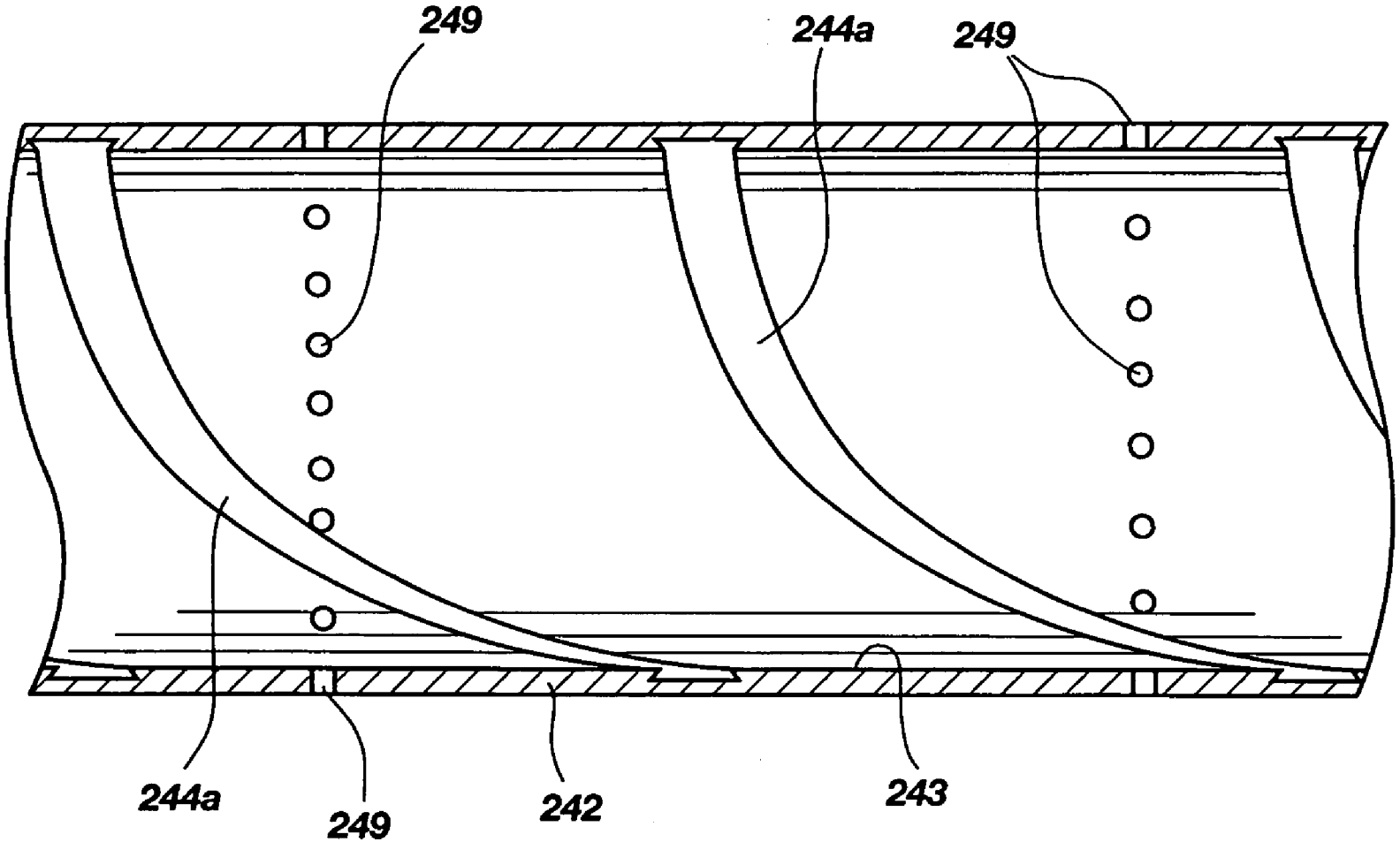
FIG. 4 is a cross-sectional view showing the sleeve of the portion of a sponge liner shown in FIG. 2.

FIGS. 2 through 4 show a portion of a sponge liner 240 according to the present invention. The sponge liner 240 comprises an annular sponge layer 241 contained within a sleeve 242. The annular sponge layer 241 may be constructed of any suitable absorptive material as known in the art, the specific material employed being application dependent. For example, annular sponge layer 241 may be constructed of a material adapted to readily absorb a specific reservoir fluid of interest, such as oil or water. The annular sponge layer 241 forms a central interior cavity 247 of a diameter substantially equal to the outside diameter of the core sample 5, such that the annular sponge layer 241 substantially contacts the outer cylindrical surface of the core sample 5. Sleeve 242 is a generally tubular structure surrounding the annular sponge layer 241 and providing structural strength and rigidity to the sponge liner 240. Also, the sleeve 242 may include a plurality of holes or other perforations 249 enabling reservoir gases entrained in the core sample 5 to expand and escape therethrough. The sleeve 242 may be constructed of any suitable material including aluminum, fiberglass, and other epoxy- or resin-based composite materials.

As noted above, debonding or peeling of the sponge material from the sleeve has been a concern with conventional sponge liners. According to the present invention, a robust, high-strength bond is provided between the annular sponge layer 241 and the sleeve 242 by one or more grooves 244 formed or machined into the interior wall 243 of the sleeve 242. The annular sponge layer 241 extends into the groove or grooves 244 to rigidly secure the annular sponge layer 241 to the sleeve 242. Extension of the annular sponge layer 241 into the groove or grooves 244 in sleeve 242 may be achieved by directly molding the annular sponge layer 241 into the sleeve 242. Alternatively, the annular sponge layer 241 may be separately fabricated and subsequently attached to the sleeve 242. Also, the annular sponge layer 241 may be further secured to the interior wall 243 of sleeve 242 using an adhesive bonding process. Other processes may be employed to increase the strength of the bond between the annular sponge layer 241 and the sleeve 242, such as an ultrasonic welding process, depending upon the selection of materials for the annular sponge layer 241 and sleeve 242, respectively.

Any suitable number, size, and configuration of grooves 244 may be formed in the interior wall 243 of the sleeve 242. For example, as best seen in FIG. 4, a single helix or spiral groove 244*a* (or multiple helix or spiral grooves) may be used. Alternatively, as shown in FIG. 3, a plurality of longitudinally extending grooves 244*b* may be employed. Further, one or more circumferentially extending grooves (not shown) may be disposed on the sleeve 242. The groove or grooves 244 may be of a dove-tail cross-section, as shown in FIGS. 2 through 4, or any other suitable shape or configuration. For example, the groove or grooves 244 may be generally circular or generally elliptical in cross-section.

Further structural strength may be imparted to the annular sponge layer 241 by a webbing layer 246. Webbing layer 246 comprises a webbing of any suitable pattern or configuration that is immersed within—or molded into—the annular sponge layer 241. Although the webbing layer 246 is shown in FIGS. 2–3 as being disposed proximate the interior surface 245 of the annular sponge layer 241, it should be understood that the webbing layer 246 may be disposed at any suitable location within the radial thickness of the annular sponge layer 241. The webbing layer 246 may comprise any suitable material known in the art, such as, by way of example, polyethylene filament or nylon filament, that does not interfere with the absorption of reservoir fluids by the annular sponge layer 241.

The webbing layer 246 provides further structural support for the annular sponge layer 241, preventing gouging of the annular sponge layer 241 by the core sample 5 and inhibiting peeling of the annular sponge layer 241 from the sleeve 242. Also, webbing layer 246 provides additional mechanical support for the core sample 5 during transportation to the surface as well as off-site. Further, by inhibiting gouging of the annular sponge layer 241 by the core sample 5, webbing layer 246 reduces friction between the core sample 5 and the annular sponge layer 241 as the core traverses the inner barrel assembly 200, thereby reducing the potential for structural damage to the core sample 5.

A sponge liner 240 may be of any suitable length. The sponge liners 240 may, for example, be provided in 5-ft or 6-ft lengths which are stacked end-to-end within each inner tube section 210*a*, 210*b*, 210*c*. If stacked end-to-end, the ends of each sponge liner 240 may be configured to provide an interlocking end-to-end connection between adjacent sponge liners 240, as will be explained in greater detail below. Although sponge liners are conventionally supplied in standard 5-ft or 6-ft lengths, it is within the scope of the present invention that a sponge liner 240 be provided in a length substantially equivalent to the length of the inner tube sections 210*a*, 210*b*, 210*c*. For example, the sponge liners 240 and inner tube sections 210*a*, 210*b*, 210*c* may be provided in 30-ft lengths, 45-ft lengths, or 60-ft lengths, or any other suitable length as desired.

Figure 5:
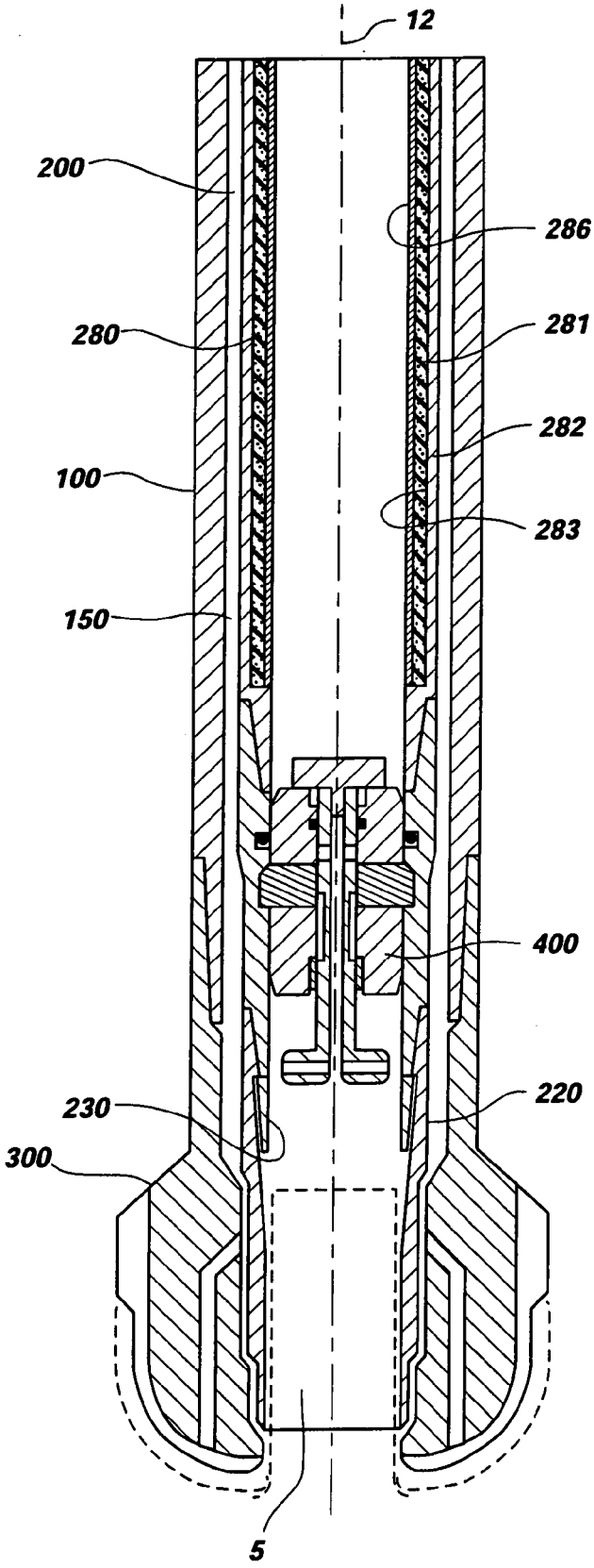
FIG. 5 shows a portion of the cross-sectional view of FIGS. 1A–1C, including an integrated sponge barrel according to the present invention.

In an alternative embodiment of the present invention, the inner barrel assembly 200, rather than being comprised of inner tube sections 210*a*, 210*b*, 210*c* and separate sponge liner or liners 240, is comprised of one or more sponge-lined inner tube sections 210*a*, 210*b*, 210*c*, or integrated sponge barrels 280, as shown in FIG. 5. Each integrated sponge barrel 280 comprises an inner tube section 282 encasing an annular layer of sponge material 281. The inner tube section 282 may be constructed of any suitable material, including both ferrous and nonferrous metals as well as resin- or epoxy-based composite materials. The annular layer of sponge material 281 is secured to, or molded onto, the interior cylindrical surface 283 of the inner tube section 282. One or more grooves (not shown in FIG. 5) may be formed or machined into the interior cylindrical surface 283 of the inner tube section 282 to secure the annular layer of sponge material 281 thereto, as shown and described with respect to FIGS. 2–4. Also, as shown in FIG. 5, the integrated sponge barrel 280 may include a layer of webbing 286 immersed in, or molded into, the annular layer of sponge material 281.

Make up of an inner barrel assembly 200 according to this embodiment of the invention may include interconnecting one or more integrated sponge barrels 280, while insertion of separate sponge liners, (as well as shims, as described below) into an inner tube section is not required. Further, an integrated sponge barrel 280 has only a single outer material layer comprised of the inner tube section 282; the integrated sponge barrel 280 does not include a sleeve 242 constructed from a first material surrounding the sponge material and encased within an inner tube constructed of a second, different material. Thus, use of one or more integrated sponge barrels 280 simplifies assembly of the inner barrel assembly 200 and eliminates differential thermal expansion between the inner tube sections and sponge liner or liners.

In a further embodiment of the invention, the inner tube sections 210*a*, 210*b*, 210*c* and the sleeve 242 of the sponge liner or liners 240 disposed therein are constructed of the same or similar materials. In this embodiment, the materials employed to construct the inner tube sections 210*a*, 210*b*, 210*c* and the sleeves 242 are the same material or, alternatively, different materials having equivalent, or nearly equivalent, rates of thermal expansion. Therefore, through proper selection of the material or materials used to construct the inner tube sections 210*a*, 210*b*, 210*c* and the sleeve 242 of each sponge liner 240, differential thermal expansion between the inner tube sections 210*a*, 210*b*, 210*c* and the sponge liner or liners 240 disposed therein, respectively, is substantially eliminated.

Figure 6:
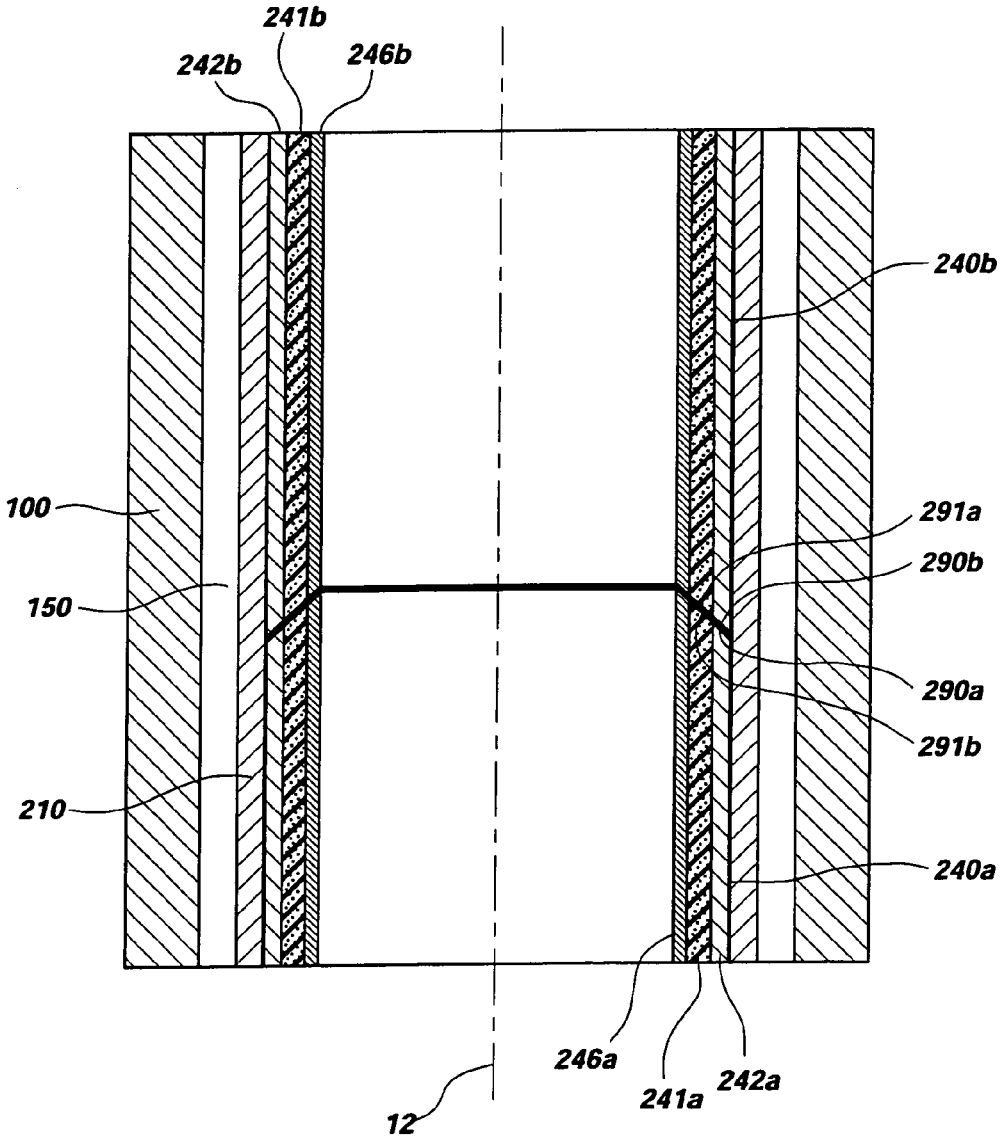
FIG. 6 shows a portion of the cross-sectional view of FIGS. 1A–1C, including a mating joint between adjacent sponge liner assemblies according to the present invention.

Referring to FIG. 6, a portion of a first sponge liner 240*a* is shown in an end-to-end relationship with a portion of a second sponge liner 240*b*. The end 290*a* of the first sponge liner 240*a* is in abutting contact with the end 290*b* of the adjacent, second sponge liner 240*b*. First sponge liner 240*a* comprises sleeve 242*a*, annular sponge layer 241*a*, and webbing layer 246*a*, while second sponge liner 240*b* comprises sleeve 242*b*, annular sponge layer 241*b*, and webbing layer 246*b*. End 290*a* of the first sponge liner 240*a* is formed to a contour 291*a* and end 290*b* of the second sponge liner 240*b* is formed to a mating contour 291*b*. The contours 291*a*, 291*b* are generally nontransverse to the longitudinal axis 12 of sponge core barrel assembly 10 and are substantially conformal to one another, such that the ends 290*a*, 290*b* of the first and second sponge liners 240*a*, 240*b*, respectively, closely mate to form an interlocking end-to-end connection between the first and second sponge liners 240*a*, 240*b*. The contours 291*a*, 291*b* may be of any suitable configuration, such as, for example, a bevel as shown in FIG. 6, a generally parabolic contour, or a tongue-in-groove configuration.

The interlocking nature of the contours 291*a*, 291*b* on the ends 290*a*, 290*b* of the first and second sponge liners 240*a*, 240*b*, respectively, centers the first and second sponge liners 240*a*, 240*b* relative to one another and prevents the formation of a gap between the ends 290*a*, 290*b* thereof, such a gap potentially creating a collection point for debris or providing a surface or edge for snagging the leading end of the core. Thus, the interlocking end-to-end connection provided by the mating contours 291*a*, 291*b* between the abutting ends 290*a*, 290*b* of two adjacent first and second sponge liners 240*a*, 240*b* provides a smooth joint over which the core sample 5 can pass without damage.

Figure 7:
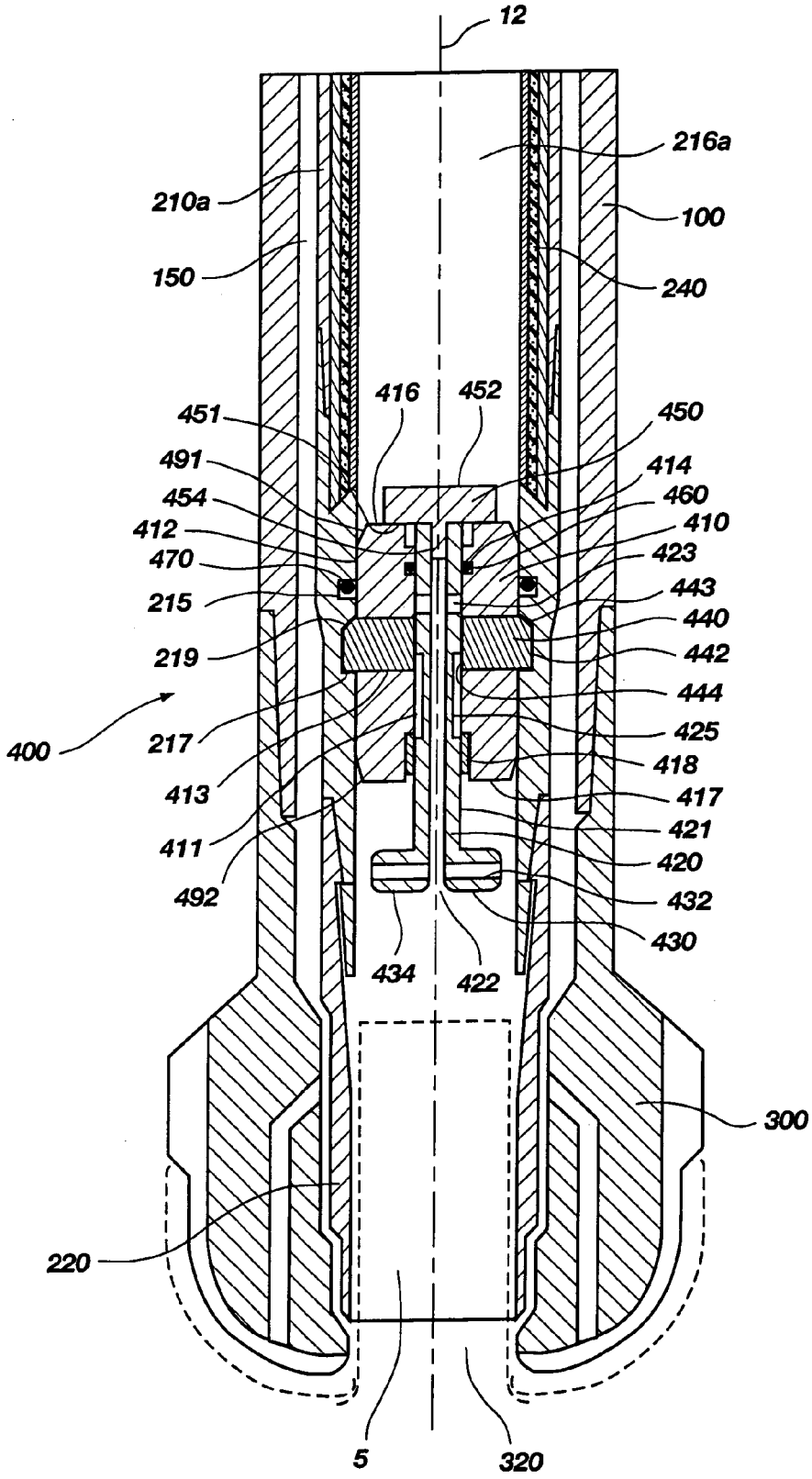
FIG. 7 shows a portion of the cross-sectional view of FIGS. 1A–1C, including a piston assembly according to the present invention.

Referring to FIG. 7, piston assembly 400 comprises a piston rod 420 slidably disposed within a bore 411 of a cylindrical piston 410, the piston 410 having an upper end 416 and a lower end 417. The piston 410 is seated within the lower end 212*a* of the lowermost inner tube section 210*a*. It should be noted that, although referred to herein as being part of the lowermost inner tube section 210*a*, the lower end 212*a* of the lowermost inner tube section 210*a* is often referred to as the upper core shoe 220 and may be a separate tubular section attached by threads to the lowermost inner tube section 210*a*. However, the specific configuration of the inner barrel assembly 200—and the particular terminology employed—is immaterial to the present invention, and those of ordinary skill in the art will understand that the various aspects of the present invention are applicable to any core barrel configuration, regardless of the particular structure and the terminology used to describe such structure.

An O-ring type seal 470 is disposed within an annular groove 215 in the interior wall of the lowermost inner tube section 210*a*, the O-ring type seal 470 providing a fluid seal between the lowermost inner tube section 210*a* and the outer cylindrical surface 412 of the piston 410. Any other suitable type of seal as known in the art may be used to provide the fluid seal between the lowermost inner tube section 210*a* and the piston 410. One or more locking elements 440 are disposed about the circumference of the piston 410. Each locking element 440 is configured to freely move within a passageway 413 extending radially through the piston 410. In its radially outermost position, as shown in FIG. 7, each locking element 440 is configured to engage an annular groove 217 in the wall of the lowermost inner tube section 210*a*. With the ends 442 of the locking elements 440 extending into the annular groove 217, the piston 410 is in the locked condition and the relative longitudinal position (along longitudinal axis 12 of the sponge core barrel assembly 10) of the piston 410 within the lowermost inner tube section 210*a* is fixed. Thus, in the locked condition, the outer cylindrical surface 412 of the piston 410 is able to interface with the O-ring type seal 470 disposed within annular groove 215 in the interior wall of lowermost inner tube section 210*a*, thereby providing the fluid seal between the piston 410 and lowermost inner tube section 210*a*.

The piston rod 420 comprises a longitudinally extending cylinder having a central bore 422 extending therethrough. The lower end of piston rod 420 comprises a disk portion 430. The disk portion 430 includes a lower, circular, planar surface 434, the bore 422 extending towards and opening onto the planar surface 434. One or more ports 432 extend radially through the disk portion 430 and are in fluid communication with the bore 422, the ports 432 extending generally transverse to the bore 422. Located proximate the upper end of the piston rod 420 are one or more radially extending ports 423; the ports 423 are also in fluid communication with the bore 422 and extending generally transverse thereto.

The end of bore 422 is sealed by a cylindrical plug 454 extending from a retaining element 450. The cylindrical plug 454 may be secured within the bore 422 of piston rod 420 using any suitable connecting method such as, for example, a threaded connection or an interference press fit. An O-ring type seal 460, or any other suitable type of seal as known in the art, resting within an annular groove 414 in the wall of bore 411 of piston 410 provides a fluid seal between the piston rod 420 and the piston 410. Thus, the fluid seal provided by the cylindrical plug 454 disposed in the end of bore 422 of piston rod 420, the fluid seal provided by the O-ring type seal 460 disposed between the piston rod 420 and piston 410, as well as the fluid seal provided by the O-ring type seal 470 disposed between the piston 410 and the lowermost inner tube section 210*a*, all function to prevent the leakage of presaturation fluid from chamber 216*a* (or chamber 205) and around piston assembly 400 when the piston 410 and associated locking elements 440 are in the locked condition.

The retaining element 450, secured to piston rod 420 by cylindrical plug 454 as noted above, retains the piston rod 420 within the bore 411 of piston 410. Gravitational forces, frictional forces exerted on the piston rod 420 by the O-ring type seal 460, and forces exerted on the upper surface 452 of the retaining element 450 due to presaturation fluid pressure within chamber 216*a* (or chamber 205) maintain the piston rod 420 in its lowermost position, with the lower surface 451 of the retaining element 450 contacting the upper end 416 of the piston 410. As will be described in greater detail below, the presaturation fluid pressure is limited by a pressure compensated inner barrel assembly 200 and, accordingly, any downwardly directed forces on the piston rod 420 as a result of the presaturation fluid pressure are minimized. Also, because the retaining element 450 does not extend radially to the interior wall of the lowermost inner tube section 210*a*, friction therebetween is nonexistent.

The interface between the lower surface 451 of the retaining element 450 and the upper end 416 of the piston 410 is not intended to provide a fluid seal, the necessary fluid seal being provided by the O-ring type seal 460, and, therefore, the lower surface 451 of the retaining element 450 may be subjected to the pressurized presaturation fluid within chamber 216*a* (or chamber 205). The exposed area of lower surface 451 is reduced in comparison to the exposed area of upper surface 452 only to the extent that the center portion of lower surface 451 is not exposed to presaturation fluid. Thus, the force exerted on the lower surface 451 as a result of pressurized presaturation fluid may not be significantly less than the corresponding force exerted on the upper surface 452.

The radial position as well as the orientation of the piston rod 420 may be constrained by a bushing 418 disposed within the piston 410 and about bore 411. Additionally, the bushing 418 serves as a linear bearing for relative sliding motion between the piston rod 420 and the piston 410. A snap ring (not shown), or any other suitable connection method such as an interference press fit, may be used to secure the bushing 418 to the piston 410.

In the locked condition, the locking elements 440 disposed in passageways 413 of piston 410 are in their radially outermost position, and the inner ends 444 of the locking elements 440 abut, or are slightly offset from, the outer cylindrical surface 421 of the piston rod 420. Located intermediate the disk portion 430 and ports 423 on piston rod 420 is an annular groove 425. The annular groove 425 is sized and located to receive the inner ends 444 of the locking element or elements 440 when the locking elements 440 are in their radially innermost position, as will be described below.

During a coring operation, the core sample 5 being cut enters the throat 320 of the core bit 300 and is guided by the core shoe 220 towards the entrance to the lowermost inner tube section 210*a*. Prior to entering the lowermost inner tube section 210*a*, the core sample 5 will contact the lower planar surface 434 of the disk portion 430 on the lower end of piston rod 420. As the core sample 5 progresses toward the entrance to the lowermost inner tube section 210*a*, the core sample 5 will push against the piston rod 420 (via planar surface 434), causing the piston rod 420 to move upward along the longitudinal axis 12. The piston rod 420 will continue to move upwardly until the disk portion 430 makes contact with the lower end 417 of the piston 410, at which point the annular groove 425 in piston rod 420 will be aligned with locking elements 440. Further, when the piston rod 420 is fully compressed by the core sample 5, the upper end of the piston rod 420 will extend past the upper end 416 of the piston 410 such that the ports 423 in piston rod 420 are clear of the bore 411 of piston 410 and are in fluid communication with the chamber 205 of inner barrel assembly 200 (or chamber 216*a* in the lowermost inner tube section 210*a*).

Upon full compression of the piston rod 420, further longitudinal progression of the core sample 5 will exert an upward force upon the piston 410 causing the piston 410 to move longitudinally upward along longitudinal axis 12. The upper end 416 and lower end 417 of the piston 410 may include reliefs 491, 492, respectively, about the outer circumferential edge thereof. The reliefs 491, 492 reduce friction and the potential for jamming of the piston 410 within the lowermost inner tube section 210*a* (as well as the intermediate and uppermost inner tube sections 210*b*, 210*c*) and, thereby, facilitate longitudinal movement of the piston 410 along longitudinal axis 12 through the inner barrel assembly 200. The reliefs 491, 492 may be of any suitable configuration known in the art, such as a chamfer, bevel, or filet.

As the piston 410 begins to move longitudinally upward, a beveled surface 443 on the outer end 442 of each locking element 440 interfaces with a mating beveled surface 219 in the annular groove 217 in the wall of the lowermost inner tube section 210*a*. The beveled surface 219 functions as a cam surface (and the beveled surface 443 as a follower) to move the locking elements 440 radially inwardly. Although shown in FIG. 7 as generally planar beveled surfaces, the particular contours of the surfaces 219, 443 may be of any suitable configuration known in the art, so long as beveled surface 219 imparts a radially inward force on the locking element 440 as beveled surface 443 moves relative to beveled surface 219.

Because, upon full compression of the piston rod 420, the annular groove 425 in the piston rod 420 is aligned with the locking element or elements 440, further upward movement of the piston 410 will force the inner end 444 of each locking element 440 into the annular groove 425. When the inner ends 444 of the locking element or elements 440 rest within the bottom of the annular groove 425 in the piston rod 420, the outer ends 442 of the locking element or elements 440 are flush with, or slightly radially inward of, the outer cylindrical surface 412 of piston 410, thereby releasing the piston 410 and allowing the piston 410 to travel upward through the inner barrel assembly 200 as the full length of the core sample 5 is cut.

As noted above, when the piston rod 420 is fully compressed, the ports 423 proximate the upper end of the piston rod 420 are in fluid communication with the chamber 205 (or chamber 216*a*). Also, as noted previously, the port or ports 423 are in fluid communication with the bore 422 extending through the piston rod 420 and the bore 422 is in fluid communication with the port or ports 432 extending radially through the disk portion 430. Thus, the ports 423, bore 422, and ports 432 cooperatively provide a passageway extending through the piston assembly 400. This passageway provides a flow path for presaturation fluid retained within chamber 205 of inner barrel assembly 200 to discharge therefrom upon entry of the core sample 5 into the lowermost inner tube section 210*a*. The presaturation fluid will flow through the passageway around the core sample 5 and towards the throat 320 of core bit 300, where the presaturation fluid is expelled into the bore hole.

The port or ports 423 are sized and located on piston rod 420 such that the fluid passageway through piston assembly 400 is established coincident with, or just prior to, disengagement of the locking elements 440 and subsequent movement of the piston 410. Thus, presaturation fluid pressure within chamber 205 of the inner barrel assembly 200 is relieved before the piston 410 traverses upwardly into the lowermost inner tube section 210*a*. Also, those of ordinary skill in the art will understand that the particular size, number, location, and configuration of ports 423, bore 422, and ports 432 may vary so long as they are cooperatively configured to provide a fluid passageway through the piston 410 prior to, or coincident with, disengagement of the locking elements 440.

In prior art piston-type sealing mechanisms, the piston was retained in the inner tube and the presaturation fluid contained within the inner tube, solely by frictional forces exerted on the piston. An O-ring in contact with the piston and the inner tube and providing a seal therebetween, as well as surfaces of the piston and inner tube in contact, provided the necessary frictional forces. In order to hold the piston in place against the forces exerted thereon by presaturation fluid held within the inner tube under pressure (in some instances, high pressure), these frictional forces are necessarily relatively high. Therefore, when the core contacts the piston, the core must apply a starting force on the piston large enough to overcome the static frictional forces exerted thereon and the forces exerted on the piston by the pressurized presaturation fluid. Once the piston has been moved a small distance, the seal provided by the O-ring will be broken and the presaturation fluid released, thereby lowering the force required to move the piston through the inner tube. Nonetheless, a large starting force is necessary to initiate movement of the piston and break the seal, and this large starting force may cause structural damage to the core sample 5.

The piston assembly 400 according to the present invention, however, does not suffer from a significant weakness of the prior art (i.e., a large starting force to initiate movement of the piston). As indicated previously, the presaturation fluid is discharged from—or is at least beginning to flow out of—the chamber 205 within the inner barrel assembly 200 prior to any upward longitudinal movement of the piston 410. Thus, forces on the piston 410 resulting from the presaturation fluid pressure are substantially non-existent during translation of the piston 410. Also, because the piston 410 is positively locked into position by the locking elements 440, high frictional forces between the piston 410 and the interior wall of the lowermost inner tube section 210*a*, (whether provided by an O-ring or resulting from contact between the piston 410 and lowermost inner tube section 210*a*) are not necessary to maintain the position of the piston 410 prior to contact with the core sample 5.

Because the piston 410 is mechanically locked by the locking elements 440, which are free-floating, the piston rod 420 is mechanically isolated from the piston 410 (i.e., the piston rod 420 can move freely within the bore 411 of piston 410 with little or no resistance to movement therefrom). Thus, as was suggested above, to move the piston rod 420 and unlock the piston 410, a core sample 5 must apply a force on the lower planar surface 434 of piston rod 420 sufficient to overcome the gravitational force, the force exerted on the piston rod 420 by the O-ring type seal 460, and the force exerted on the retaining element 450 as a result of presaturation fluid pressure. The gravitational force and, by appropriate design, the force exerted on the piston rod 420 by the O-ring type seal 460 will be relatively small. Further, the pressure exerted on the upper surface 452 of the retaining element 450 is limited by the pressure compensated chamber 205 within inner barrel assembly 200, as will be described in greater detail below. Therefore, in comparison to prior art piston-type sealing mechanisms, the force necessary to activate the piston assembly 400 of the present invention is relatively small and mechanical damage to the core sample 5 minimized.

Figure 8:
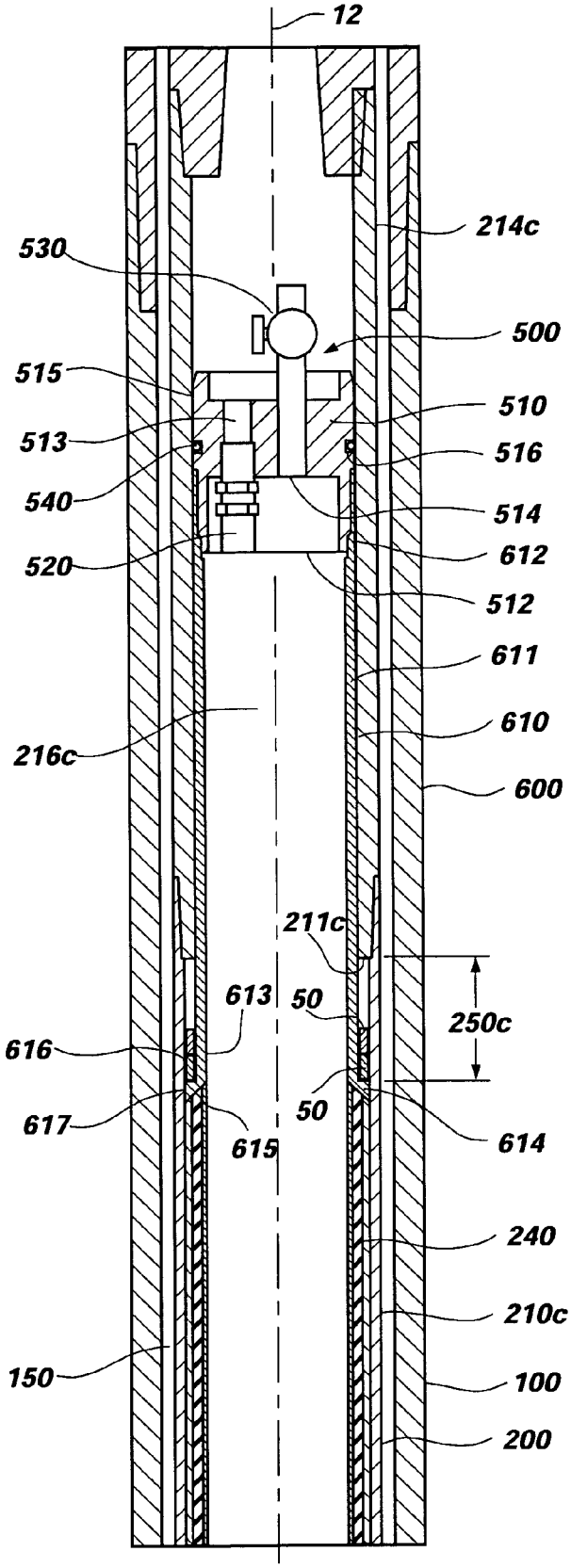
FIG. 8 shows a portion of the cross-sectional view of FIGS. 1A–1C, including a pressure compensation mechanism and a thermal compensation mechanism, both according to the present invention.

Referring to FIG. 8, disposed proximate the upper end 214*c* of the uppermost inner tube section 210*c* are the pressure compensation mechanism 500 and the thermal compensation mechanism 600. The pressure compensation mechanism 500 comprises a cylindrical housing 510 having an outer cylindrical surface 515 of a diameter substantially equal to, although slightly less than, the inside diameter of the uppermost inner tube section 210*c*. An O-ring type seal 540, or any other suitable type of seal as known in the art, may be disposed within an annular groove 516 in the cylindrical housing 510. The O-ring type seal 540 provides a fluid seal between the cylindrical housing 510 and the interior wall of the uppermost inner tube section 210*c*. Thus, the pressure compensation mechanism 500 and the piston assembly 400 provide the upper and lower fluid seals, respectively, for the presaturation fluid chamber 205 within inner barrel assembly 200.

A port 513 extends longitudinally (along longitudinal axis 12) through the cylindrical housing 510. Disposed on port 513 is a pressure relief element 520 configured to open and release presaturation fluid from the chamber 205 when the pressure within chamber 205 achieves a specified threshold. The pressure relief element 520 may be any suitable pressure relief valve or mechanism known in the art, so long as the pressure relief element 520 maintains the presaturation fluid within a specified pressure limit. Presaturation fluid released from the chamber 205 via pressure relief element 520 can flow into the annular region 150 via passageways (not shown) extending through the uppermost inner tube section 210*c* and above the pressure compensation mechanism 500. The released presaturation fluid may then travel through the annular region 150 to be discharged into the bore hole.

During coring, thermal expansion of the presaturation fluid as a result of high downhole temperature and compression of the core barrel assembly due to high downhole pressure may cause the presaturation fluid pressure within the chamber 205 to increase significantly. Whenever the presaturation fluid pressure within chamber 205 reaches the specified limit of the pressure relief element 520, however, the pressure relief element 520 will release a limited volume of presaturation fluid sufficient to lower the presaturation fluid pressure to within the specified limit. Thus, pressure compensation mechanism 500 provides a mechanism—i.e., pressure relief element 520—for continually compensating for changes in fluid pressure within the inner barrel assembly 200, regardless of the cause of the pressure increase.

The cylindrical housing 510 of pressure compensation mechanism 500 may include at least one other port 514 extending longitudinally therethrough. The port 514 provides a passageway for the introduction of presaturation fluid into the chamber 216*c* of the uppermost inner tube section 210*c*. Disposed on the port 514 is a valve 530 configured for selectively opening and closing the port 514. The valve 530 may be any suitable valve known in the art, including a tap or ball valve, so long as the valve 530 allows for the passage therethrough of presaturation fluid when open and stops, or substantially inhibits, the flow therethrough of presaturation fluid when closed.

The lower end 512 of the cylindrical housing 510 of pressure compensation mechanism 500 is mechanically coupled to the thermal compensation mechanism 600. The thermal compensation mechanism 600 comprises an adjusting sleeve 610. The adjusting sleeve 610 includes a tubular body 611 having an upper end 612 secured, as by threads, for example, to the lower end 512 of cylindrical housing 510 of pressure compensation mechanism 500. A lower end 613 of the tubular body 611 includes a flange 614. The flange 614 includes a lower bearing surface 615, an upper bearing surface 616, and an outer bearing surface 617.

The outer bearing surface 617 of flange 614 is configured to mate closely with the interior wall of uppermost inner tube section 210*c* and to slide relative thereto. Lower bearing surface 615 is configured to rest against the upper end of the sponge liner 240 (or uppermost sponge liner 240, if more than one). The upper bearing surface 616 of the flange 614 is configured to abut one or more shims 50 or, if no shims 50 are present, to abut a shoulder 211*c* formed in the wall of the uppermost inner tube section 210*c*, as will be explained in greater detail below. It should be noted that, although referred to herein as being a part of the uppermost inner tube section 210*c*, a portion of the upper end 214*c* of the uppermost inner tube section 210*c* is commonly referred to as an upper connector sub and is a separately attached section, the shoulder 211*c* being provided by a lower end of the upper connector sub. Again, however, the specific configuration of the inner barrel assembly and the particular terminology attached to the various features of the inner barrel assembly are immaterial to the present invention, and those of ordinary skill in the art will understand that the various aspects of the present invention are applicable to any core barrel configuration, regardless of the particular structure and the terminology used to describe such structure.

During make up of a sponge core barrel assembly, one or more sponge liners 240 are disposed within the uppermost inner tube section 210*c* to substantially fill the length thereof, leaving only a relatively small nonlined length of tube proximate the upper end 214*c* of the uppermost inner tube section 210*c*. The adjusting sleeve 610 of thermal compensation mechanism 600 with attached pressure compensation mechanism 500 is then disposed in the uppermost inner tube section 210*c*, such that the lower bearing surface 615 on the flange 614 at the lower end 613 of the tubular body 611 of adjusting sleeve 610 rests against the upper end of the sponge liner 240 (or uppermost sponge liner 240, if more than one). The outer bearing surface 617 on the flange 614 is slidably disposed against the interior wall of the uppermost inner tube section 210*c*. With the lower bearing surface 615 abutting the end of the sponge liner 240, a gap 250*c* will exist between the shoulder 211*c* on the wall of the uppermost inner tube section 210*c* and the upper bearing surface 616 on the flange 614.

The sponge liner 240 may include an outer sleeve 242 constructed of a material, such as aluminum, that may have a coefficient of thermal expansion significantly greater than the coefficient of thermal expansion of the material used to construct the inner tube sections 210*a*, 210*b*, 210*c*, which is typically a steel alloy. The temperature in the bore hole is usually significantly higher than the ambient temperature at the surface; thus, as the sponge core barrel assembly 10 is lowered into the bore hole for coring, the uppermost inner tube section 210*c* and sponge liner or liners 240 disposed therein will expand due to the increase in temperature. Because of the differences in material properties of the uppermost inner tube section 210*c* and the sleeve 242 of a sponge liner 240, differential thermal expansion will occur between the uppermost inner tube section 210*c* and the sponge liners 240, and the gap 250*c* between the shoulder 211*c* and the upper bearing surface 616 will narrow.

The downhole temperature can be estimated or measured and, therefore, the magnitude of the differential thermal expansion between the uppermost inner tube section 210*c* and sponge liner or liners 240 can be approximated. Based on the estimated differential thermal expansion, a specified number of shims 50, which are cylindrical ring-shaped structures of a known thickness, are placed between the upper bearing surface 616 of the adjusting sleeve 610 and the shoulder 211*c* on the wall of the uppermost inner tube section 210*c*. The total thickness of the specified number of shims 50 is sufficient to fill the remainder of gap 250*c* such that, upon full differential thermal expansion, the uppermost shim 50 (or the upper bearing surface 616 if no shims 50 are necessary) is contacting, or is in close proximity to, the shoulder 211*c*. Thus, the gap 250*c* having a specified number of shims 50 disposed therein is configured to compensate for the differential thermal expansion between the uppermost inner tube section 210*c* and one or more sponge liners 240 disposed therein.

During differential thermal expansion, the sponge liner 240 (or uppermost sponge liner 240, if more than one) will push upwardly against the lower bearing surface 615 of the flange 614 at the lower end 613 of the adjusting sleeve 610, causing the adjusting sleeve 610 and attached pressure compensation mechanism 500 to move upwards longitudinally along longitudinal axis 12. Longitudinal movement of the adjusting sleeve 610 and attached pressure compensation mechanism 500 is guided, at the lower end 613 thereof, by the outer bearing surface 617 on the adjusting sleeve 610 and, at the upper end thereof, by the outer cylindrical surface 515 of cylindrical housing 510. The O-ring type seal 540 maintains the fluid seal between the uppermost inner tube section 210*c* and the cylindrical housing 510 during longitudinal movement thereof.

As the cylindrical housing 510 of pressure compensation mechanism 500 moves upwardly through the uppermost inner tube section 210*c* due to an upward force applied thereto by the adjusting sleeve 610 of thermal compensation mechanism 600, the volume of chamber 205 within inner barrel assembly 200 will increase, the magnitude of the volume increase being a function of the differential thermal expansion of the uppermost inner tube section 210*c* relative to the sponge liner or liners 240 disposed therein. This increase in volume of the chamber 205 will "absorb" at least a portion of the expanded volume of the presaturation fluid, which, as noted above, also thermally expands as a result of the relatively high downhole temperature. Therefore, the thermal compensation mechanism 600 performs a pressure compensation function in that thermal compensation mechanism 600 may expand the volume of chamber 205 available to contain presaturation fluid, thereby lowering the presaturation fluid pressure. Thus, pressure compensation mechanism 500 and thermal compensation mechanism 600 cooperate to maintain the presaturation fluid pressure at or below a specified threshold value.

It is also within the scope of the present invention that differential thermal expansion between the inner tube sections 210*a*, 210*b*, 210*c* and the sponge liners 240 be eliminated, or at least reduced, by constructing the inner tube sections 210*a*, 210*b*, 210*c* and the sleeve 242 of each sponge liner or liners 240 from the same material, such as aluminum, steel, or a resin- or epoxy-based composite material. If like materials are used to construct both the inner tube sections 210*a*, 210*b*, 210*c* and the sponge liner sleeve or sleeves 242, thereby minimizing differential thermal expansion, the thermal compensation mechanism 600 may no longer be necessary (although shims 50 may be needed to substantially fill any gap 250*c*). Without thermal compensation mechanism 600, the presaturation fluid pressure in chamber 205 of inner barrel assembly 200 is controlled by pressure compensation mechanism 500.

Figure 9:
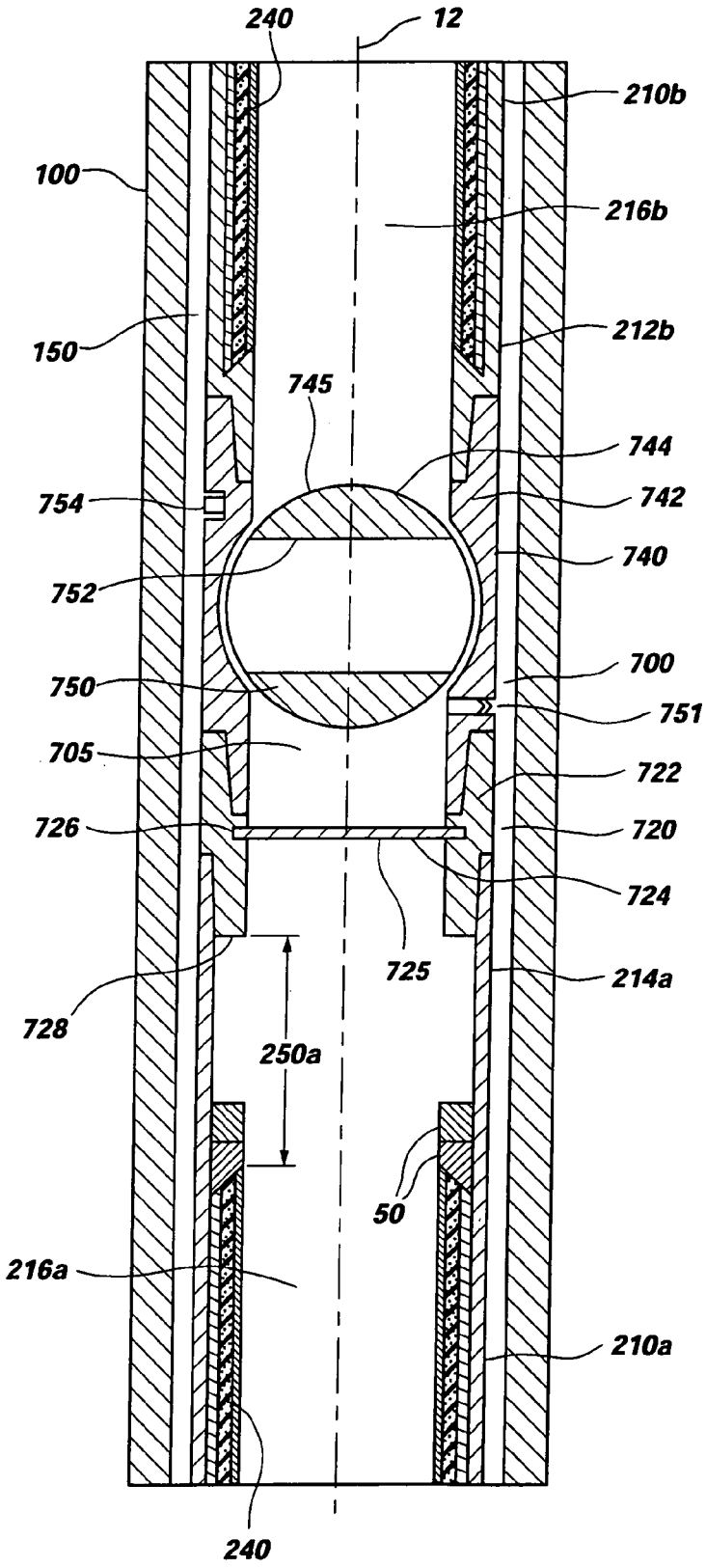
FIG. 9 shows a portion of the cross-sectional view of FIGS. 1A–1C, including a first embodiment of a valve mechanism according to the present invention.

With reference to FIGS. 1A–1C and 9, the first embodiment of a valve assembly 700 includes a lower seal assembly 720 secured, for example, by threads, to the upper end 214*a* of the lowermost inner tube section 210*a*. The first valve assembly 700 further includes an upper seal assembly 740 secured, as by threads, to the lower end 212*b* of the intermediate inner tube section 210*b*. After presaturation of the individual inner tube sections 210*a*, 210*b*, 210*c* and make up of the inner barrel assembly 200, as will be described in greater detail below, the lower seal assembly 720 is secured to the upper seal assembly 740. The lower seal assembly 720 includes a housing 722 and a sealing element 724 secured therein. The sealing element 724 may comprise a generally planar diaphragm 725, as shown in FIG. 9. Similarly, the upper seal assembly 740 includes a housing 742 and a sealing element 744 secured therein. The sealing element 744 may comprise a ball valve 745. When the lower and upper seal assemblies 720, 740 are interconnected, a chamber 705 is formed between the sealing element 724 of the lower seal assembly 720 and the sealing element 744 of the upper seal assembly 740.

Referring to FIG. 9, the ball valve 745 comprising sealing element 744 of the first valve assembly 700 may be configured as any conventional ball valve known in the art. Generally, the ball valve 745 includes a ball element 750 having a cylindrical fluid passageway 752 extending therethrough. The fluid passageway 752 has a diameter substantially the same as the inner diameter of the inner tube sections 210*a*, 210*b*, 210*c* (inner diameter of the sponge liner or liners 240). An actuator mechanism (not shown) is provided for rotating the ball element 750 between the fully closed position, as shown in FIG. 9, and the fully open position. An external key 754 may be provided on the outer wall of the upper seal assembly 740 for operating the actuator mechanism.

Figure 10:
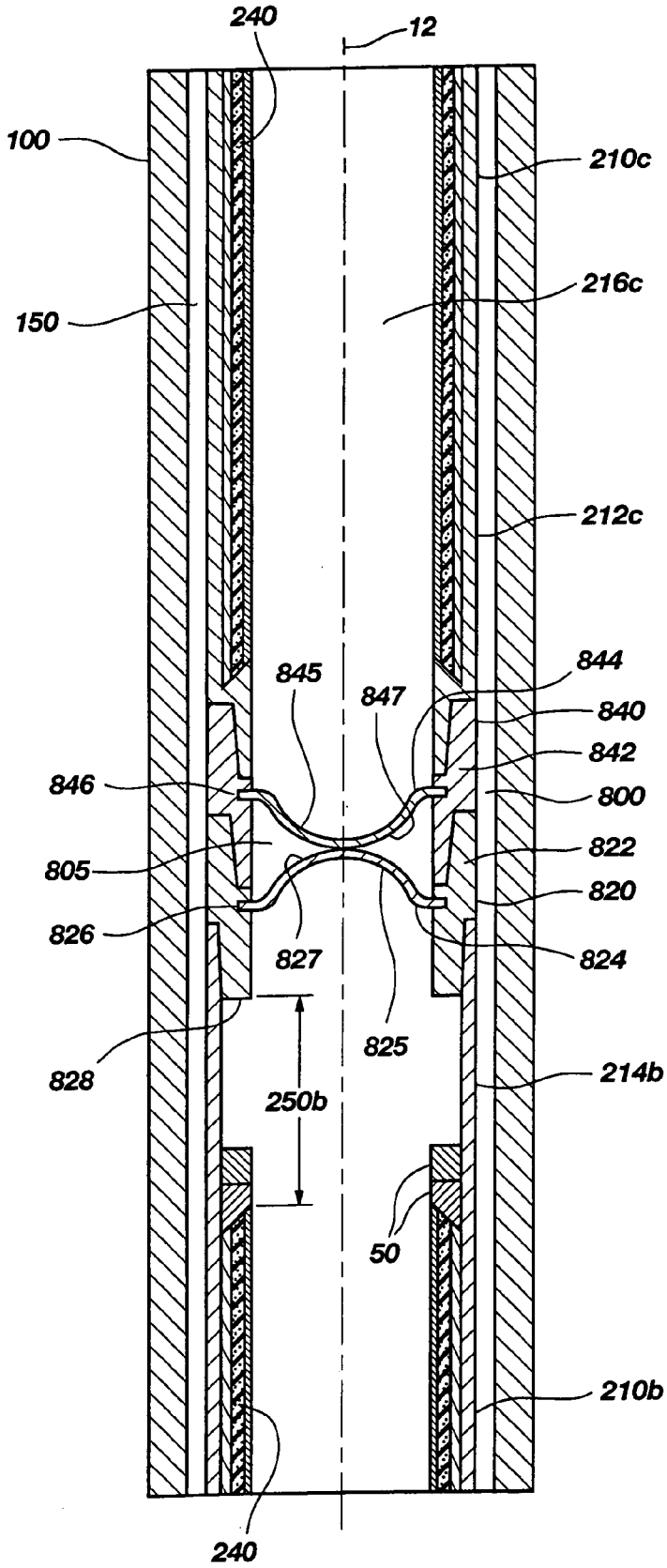
FIG. 10 shows a portion of the cross-sectional view of FIGS. 1A–1C, including a second embodiment of a valve assembly according to the present invention.

Referring to FIGS. 1A through 1C and 10, the second embodiment of a valve assembly 800 includes a lower seal assembly 820 secured, for example, by threads, to the upper end 214*b* of the intermediate inner tube section 210*b*. The second valve assembly 800 further includes an upper seal assembly 840 secured, as by threads, to the lower end 212*c* of the uppermost inner tube section 210*c*. After presaturation of the individual inner tube sections 210*a*, 210*b*, 210*c* and make up of the inner barrel assembly 200, the lower seal assembly 820 is secured to the upper seal assembly 840. The lower seal assembly 820 includes a housing 822 and a sealing element 824 secured therein. The sealing element 824 may comprise a dome-shaped diaphragm 825, as shown in FIG. 10. Similarly, the upper seal assembly 840 includes a housing 842 and a sealing element 844 secured therein. The sealing element 844 may comprise another dome-shaped diaphragm 845. When the lower and upper seal assemblies 820, 840 are interconnected, a chamber 805 is formed between the sealing element 824 of the lower seal assembly 820 and the sealing element 844 of the upper seal assembly 840.

Figure 11:
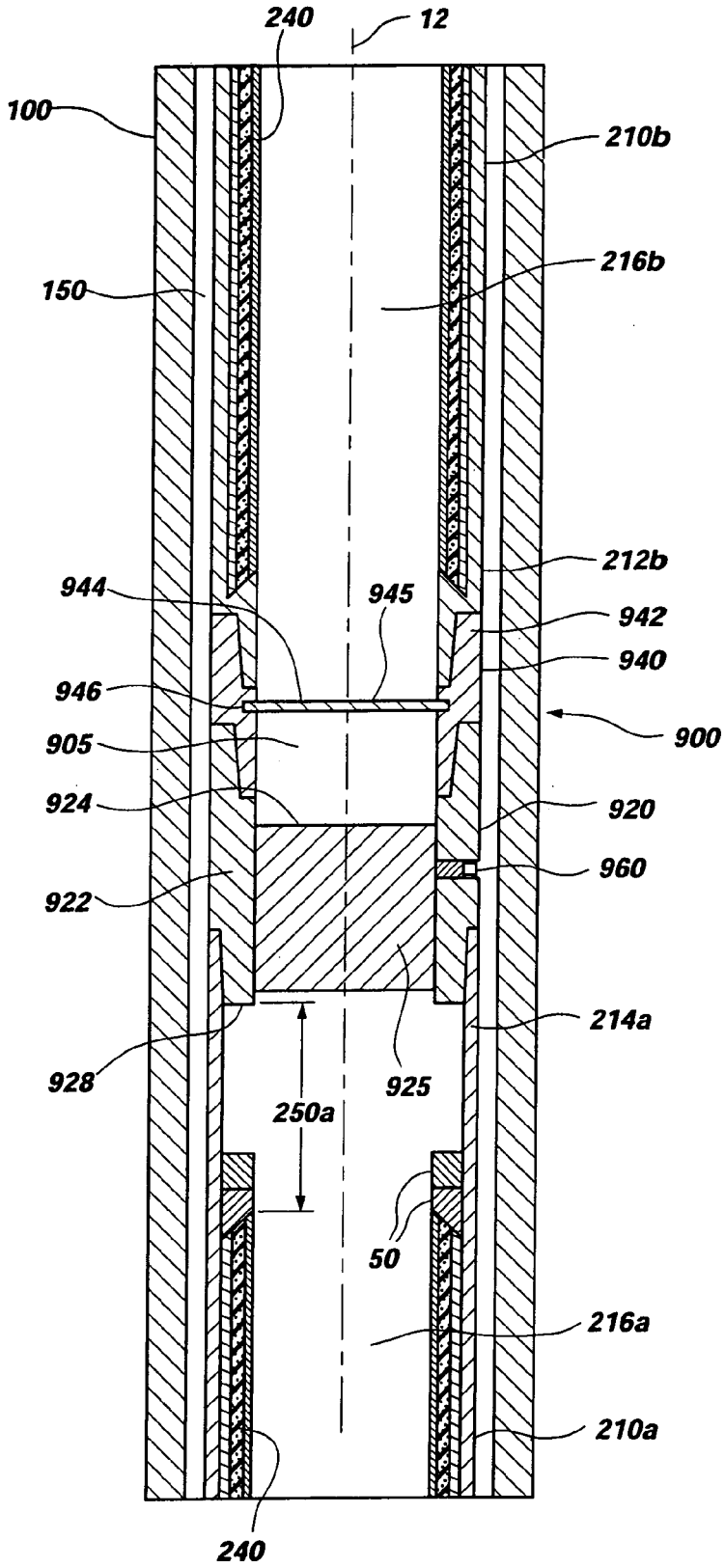
FIG. 11 shows a portion of the cross-sectional view of FIGS. 1A–1C, further including a third embodiment of a valve assembly according to the present invention.

In a further alternative embodiment, as shown in FIG. 11, a valve assembly 900 comprises a lower seal assembly 920 and an upper seal assembly 940. The lower seal assembly 920 is secured to, for example, the upper end 214*a* of the lowermost inner tube section 210*a*, and the upper seal assembly 940 is secured to the lower end 212*b* of the intermediate inner tube section 210*b*. After presaturation of the individual inner tube sections 210*a*, 210*b*, 210*c* and make up of the inner barrel assembly 200, the lower seal assembly 920 is secured to the upper seal assembly 940. The lower seal assembly 920 comprises a housing 922 and a sealing element 924 retained therein. In this embodiment, sealing element 924 comprises a releasable piston 925 held in place by a retaining element 960. Retaining element 960 may comprise a threaded bolt impinging against the outer cylindrical surface of the releasable piston 925, as shown in FIG. 11, or any other suitable device known in the art, such as a clamp or a retaining pin. The releasable piston 925 is to provide a fluid seal between the outer cylindrical surface of the releasable piston 925 and the interior wall of the lower seal assembly housing 922 configured as by, for example, appropriate dimensioning or by the inclusion of an O-ring type seal (not shown). When the piston is released via actuation of the retaining element 960, the releasable piston 925 is free-floating within the inner barrel assembly 200. The upper seal assembly 940 comprises a housing 942 and a sealing element 944 secured therein, the sealing element 944 comprising a generally planar diaphragm 945. When the lower and upper seal assemblies 920, 940 are interconnected, a chamber 905 is formed between the sealing element 924 of lower seal assembly 920 and the sealing element 944 of the upper seal assembly 940.

The diaphragm 725 of the valve assembly 700, the dome-shaped diaphragms 825, 845 of the valve assembly 800, and the planar diaphragm 945 of the valve assembly 900 may be constructed of any suitable material as known in the art, so long as the diaphragms 725, 825, 845, 945 fail, or rupture, upon application of the appropriate load or fluid pressure, as will be explained below. The diaphragms 725, 825, 845, 945 may be secured within their respective housings 722, 822, 842, 942 by any suitable method known in the art. For example, the diaphragms 725, 825, 845, 945 may be adhesively bonded to or, alternatively, molded into, annular grooves 726, 826, 846, 946 in the housings 722, 822, 842, 942, respectively.

In the assembled inner barrel assembly 200—comprising lowermost inner tube section 210*a*, intermediate inner tube section 210*b*, and uppermost inner tube section 201*c*—the valve assemblies 700, 800, 900 provide fluid seals between successive inner barrel sections. Accordingly, the lowermost inner tube section 210*a*, having piston assembly 400 at its lower end 212*a* and lower seal assembly 720 of valve assembly 700 (or lower seal assembly 920 of valve assembly 900) at its upper end 214*a*, forms a sealed chamber 216*a* that may individually be filled with presaturation fluid. Similarly, the intermediate inner tube section 210*b*, having upper seal assembly 740 of valve assembly 700 (or upper seal assembly 940 of valve assembly 900) at its lower end 212*b* and lower seal assembly 820 of valve assembly 800 at its upper end 214*b*, forms a sealed chamber 216*b*, and the uppermost inner tube section 210*c*, having upper seal assembly 840 of valve assembly 800 at its lower end 212*c* and pressure compensation mechanism 500 at its upper end 214*c*, forms a sealed chamber 216*c*, each of which may individually be filled with presaturation fluid. Thus, the inner tube sections 210*a*, 210*b*, 210*c* may be individually presaturated and then subsequently interconnected to form inner barrel assembly 200.

During interconnection of the separately presaturated inner tube sections 210*a*, 210*b*, 210*c*, having sealed fluid chambers 216*a*, 216*b*, 216*c*, respectively, the sealed fluid chambers 216*a*, 216*b*, 216*c* of the inner tube sections 210*a*, 210*b*, 210*c* are joined to form a continuous fluid chamber 205 extending substantially the length of the inner barrel assembly 200. To form the single continuous chamber 205, fluid communication is established between the individual sealed fluid chambers 216*a*, 216*b*, 216*c* by actuation of, or opening of, the valve assemblies 700 (or 900) and 800.

Opening of the valve assemblies 700, 800, 900 may be performed by employing any one of a number of methods and/or devices, or a combination thereof. For example, referring again to FIG. 9, the valve assembly 700, having a lower seal assembly 720 including a sealing element 724 comprised of a generally planar diaphragm 725 and an upper seal assembly 740 including a sealing element 744 comprised of a ball valve 745, may be opened by first rupturing the diaphragm 725 and subsequently opening the ball valve 745. The diaphragm 725 may be ruptured by the compression of fluid within chamber 705 during the interconnection of the lower and upper seal assemblies 720, 740. Alternatively, after the lower and upper seal assemblies 720, 740 have been interconnected, a known volume of presaturation fluid may be introduced into the chamber 705 through a tap 751 to create a fluid pressure within chamber 705 sufficient to burst the diaphragm 725. The valve assembly 700 may also be opened by first opening the ball valve 745, creating a differential fluid pressure across the diaphragm 725 sufficient to rupture the diaphragm 725.

Referring to FIG. 10, the valve assembly 800, having a lower seal assembly 820 including a sealing element 824 comprised of a dome-shaped diaphragm 825 and an upper seal assembly 840 including a sealing element 844 comprised of a dome-shaped diaphragm 845, may be opened by rupturing both dome-shaped diaphragms 825, 845. The dome-shaped diaphragms 825, 845 are configured such that, upon interconnection of the lower and upper seal assemblies 820, 840, an upwardly extending curved surface 827 of the dome-shaped diaphragm 825 will impinge against a downwardly extending curved surface 847 of the dome-shaped diaphragm 845. The dome-shaped diaphragms 825, 845 are configured such that the forces exerted on the dome-shaped diaphragms 825, 845 as a result of the mutual engagement of curved surfaces 827, 847 are sufficient to rupture both dome-shaped diaphragms 825, 845. Also, rupturing of the dome-shaped diaphragms 825, 845 may be facilitated by compression of fluid within chamber 805 upon interconnection of the lower and upper seal assemblies 820, 840. Further, the valve assembly 800 may include a tap 751 (see FIG. 9) for introducing a volume of presaturation fluid into the chamber 805 to create a fluid pressure within chamber 805 sufficient to burst the dome-shaped diaphragms 825, 845, either alone or in combination with contact between the curved surfaces 827, 847 of the dome-shaped diaphragms 825, 845, respectively.

Referring to FIG. 11, the valve assembly 900, having a lower seal assembly 920 including a sealing element 924 comprised of a releasable piston 925 and an upper seal assembly 940 including a sealing element 944 comprised of a generally planar diaphragm 945, may be opened by rupturing the planar diaphragm 945 and subsequently releasing the releasable piston 925; the releasable piston 925 then being free-floating within the inner barrel assembly 200. The planar diaphragm 945 may be ruptured by compression of fluid within chamber 905 upon interconnection of the lower and upper seal assemblies 920, 940. Alternatively, the valve assembly 900 may include a tap (see FIG. 9) for introducing a volume of presaturation fluid into the chamber 905 to create a fluid pressure within chamber 905 sufficient to burst the releasable piston 925.

Those of ordinary skill in the art will appreciate that the valve assemblies 700, 800, 900 may include combinations of sealing elements other than the planar diaphragm 725 and ball valve 745 combination (see FIG. 9), the dome-shaped diaphragm 825 and dome-shaped diaphragm 845 combination (see FIG. 10), and the releasable piston 925 and planar diaphragm 945 combination (see FIG. 11) shown and described herein. For example, a planar diaphragm-planar diaphragm combination, a ball valve-ball valve combination, a releasable piston-releasable piston combination, and a planar diaphragm-dome-shaped diaphragm combination are believed suitable. Further, a diaphragm may include a shape other than a generally planar shape or a dome shape. By way of example, a diaphragm may include a generally conical shape having an apex configured for piercing another diaphragm.

Although the exemplary embodiments of the present invention, as illustrated in FIGS. 1A–1C, 7, 8, 9, 10, and 11, show three interconnected inner tube sections 210*a*, 210*b*, 210*c* separated by valve assemblies 700 (or 900), 800, those of ordinary skill in the art will appreciate that any suitable number and combination of inner tube sections 210*a*, 210*b*, 210*c* and valve assemblies 700, 800, 900 according to the present invention may be employed to perform sponge coring operations. For example, two inner tube sections separated by one valve assembly 700, 800, 900 may be used. Alternatively, four inner tube sections may be employed separated from one another by valve assemblies 700, 800, 900.

To summarize, the valve assembly 700 (or valve assembly 900) disposed between the lowermost inner tube section 210*a* and the intermediate inner tube section 210*b* and the valve assembly 800 disposed between the intermediate inner tube section 210*b* and the uppermost inner tube section 210*c* enable the inner tube sections 210*a*, 210*b*, 210*c* to be assembled and individually filled with pressurized presaturation fluid prior to make up of the inner barrel assembly 200. Secondly, during make up of the inner barrel assembly 200, the valve assemblies 700 (or 900) and 800 enable the sealed fluid chambers 216*a*, 216*b*, 216*c* of the inner tube sections 210*a*, 210*b*, 210*c*, respectively, to be joined in fluid communication with one another to form a single continuous chamber 205 within the inner barrel assembly 200 for retaining presaturation fluid and, subsequently, for retaining a single length of core sample 5.

Referring to FIGS. 9 through 11, upon assembly of the lowermost inner tube section 210*a*, a gap 250*a* exists between the top end of the sponge liner 240 (or uppermost sponge liner 240, if more than one) disposed therein and a shoulder 728 (or 928) provided by the bottom end of the lower seal assembly 720 of valve assembly 700 (or the lower seal assembly 920 of valve assembly 900). Similarly, the intermediate inner tube section 210*b* exhibits a gap 250*b* between the top end of the sponge liner or liners 240 disposed therein and a shoulder 828 provided by the bottom end of the lower seal assembly 820 of valve assembly 800. One or more shims 50 may be disposed in each of the gaps 250*a*, 250*b* such that, upon full differential thermal expansion between the sponge liner or liners 240 disposed in each of the inner tube sections 210*a*, 210*b*, the top of the uppermost shim 50 in the gap 250*a* abuts or is substantially close to the shoulder 728 (or 928) and the top of the uppermost shim 50 in the gap 250*b* abuts or is substantially close to the shoulder 828. As was discussed above with respect to the shims 50 disposed in the gap 250*c* between the shoulder 211*c* of the uppermost inner tube section 210*c* and the upper bearing surface 616 of the flange 614, the appropriate number of shims 50 to be disposed in the gaps 250*a*, 250*b*, respectively, is predetermined based on an estimated or measured downhole temperature.

Figures 12A, 12B, 12C:
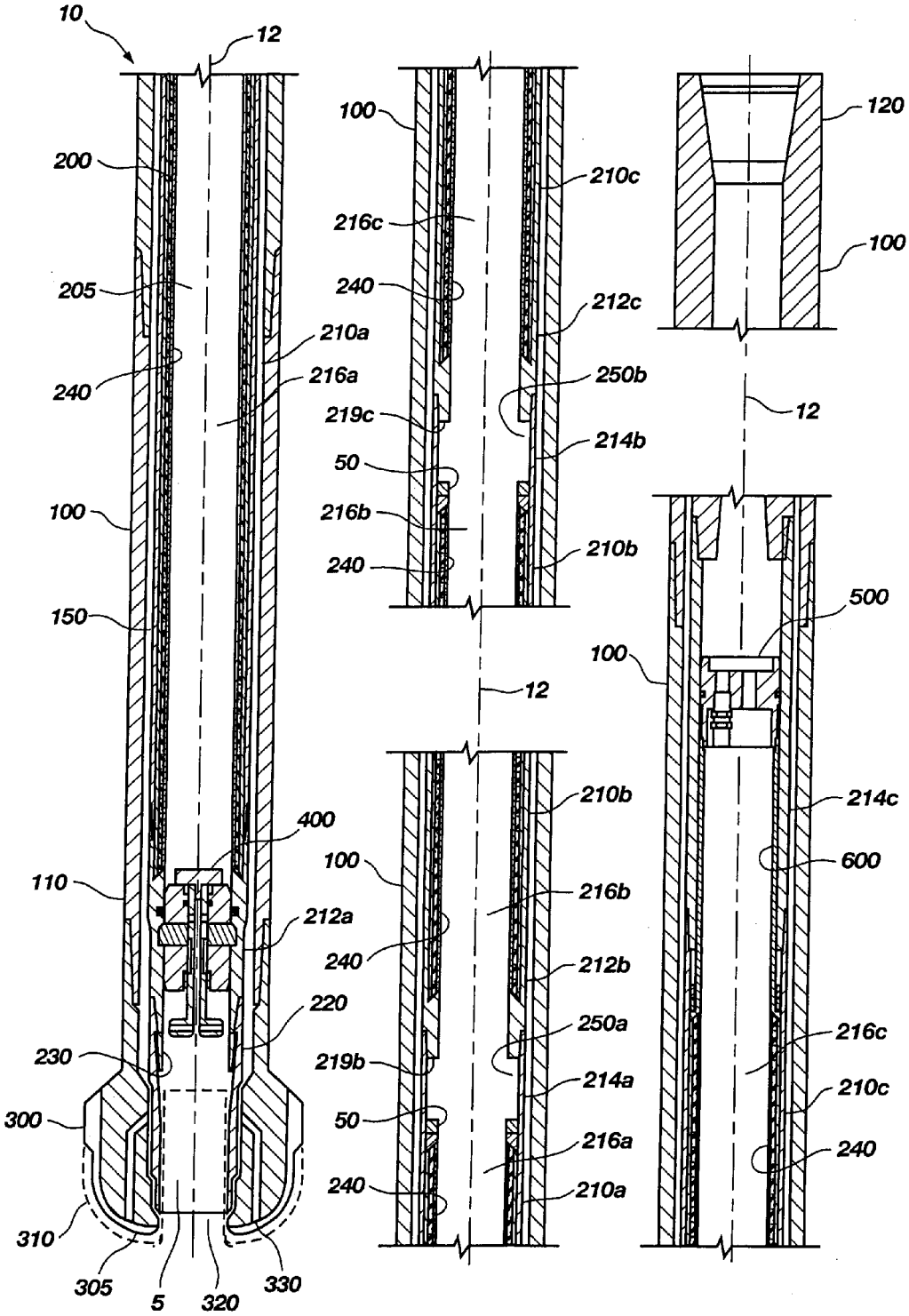
FIGS. 12A–12C show a partial, expanded cross-sectional view of a sponge core barrel assembly according to another embodiment of the present invention.

In another embodiment, as shown in FIGS. 12A–12C, the inner tube sections 210*a*, 210*b*, 210*c* are directly interconnected, and no valve assemblies 700, 800, 900 are used. In this embodiment, the upper end 214*a* of the lowermost inner tube section 210*a* is directly secured, as by threads, for example, to the lower end 212*b* of the intermediate inner tube section 210*b*. Similarly, the upper end 214*b* of the intermediate inner tube section 210*b* is directly secured to the lower end 212*c* of the uppermost inner tube section 210*c*. Thus, the fluid chambers 216*a*, 216*b*, 216*c* of the inner tube sections 210*a*, 210*b*, 210*c*, respectively, are interconnected to form a single, continuous fluid chamber 205 for receiving presaturation fluid.

For the inner barrel assembly 200 shown in FIG. 12A–12C, a gap 250*a* may exist between the top end of the sponge liner 240 (or uppermost sponge liner 240, if more than one) disposed in the lowermost inner tube section 210*a* and a shoulder 219*b* provided at the lower end 212*b* of the intermediate inner tube section 210*b*. A similar gap 250*b* may exist between the top end of the sponge liner 240 (or uppermost sponge liner 240, if more than one) disposed in the intermediate inner tube section 210*b* and a shoulder 219*c* provided at the lower end 212*c* of the uppermost inner tube section 210*c*. One or more shims 50 may be placed in each of the gaps 250*a*, 250*b* to fill the gaps 250*a*, 250*b*. Alternatively, if differential thermal expansion occurs between the inner tube sections 210*a*, 210*b*, and the sponge liner or liners 240 disposed therein, respectively, as noted above, one or more shims 50 may be placed in each of the gaps 250*a*, 250*b* to fill the remainder of the gaps 250*a*, 250*b*.

The inner barrel assembly 200 of FIGS. 12A–12C can be assembled on the rig floor and subsequently evacuated and filled with presaturation fluid. Prior to insertion into the outer barrel assembly 100, the inner barrel assembly 200 may be temporarily stored in a mouse hole and, alternatively, presaturation of the inner barrel assembly 200 may occur while the inner barrel assembly 200 is located in the mouse hole. The piston assembly 400 provides a fluid seal at a lower end of the fluid chamber 205, and the pressure compensation mechanism 500 provides a fluid seal at an upper end of the chamber 205. The entire presaturated inner barrel assembly 200 (having the single, continuous fluid chamber 205 filled with presaturation fluid) can then be disposed in the outer barrel assembly 100. The introduction of presaturation fluid into the inner barrel assembly 200 shown in FIGS. 12A–12C may also occur after the inner barrel assembly 200 is disposed in the outer barrel assembly 100.

For either of the core barrel assemblies shown and described with respect to FIGS. 1A–1C and 12A–12C, respectively, friction between the sponge-lined inner barrel assembly 200 and the core sample 5 may be significantly reduced by using one or more sponge liners 240 or, optionally, one or more integrated sponge barrels 280, according to the invention. Specifically (see FIG. 2), a layer of webbing material 246 may be molded into or immersed within the annular sponge layer 241 of the sponge liner or liners 240, or a layer of webbing material 286 may be molded into or immersed within the sponge material 281 of the integrated sponge barrel or barrels 280. Reducing friction between the core sample 5 and inner barrel assembly 200 can protect against fracture of the core sample 5, thereby improving core integrity, especially for an extended-length inner barrel assembly 200 (i.e., one having a length greater than the conventional 30 feet).

In a further embodiment of the present invention, the sponge core barrel assembly 10 includes a swivel assembly disposed proximate the core bit. Conventionally, the swivel assembly in a core barrel is disposed proximate the upper end of the outer barrel assembly and the upper end of the inner barrel assembly is secured to the swivel assembly such that the inner barrel assembly is suspended therefrom within the outer barrel assembly. The swivel assembly, therefore, supports the inner barrel assembly within the outer barrel assembly and—through the action of one or more bearings—enables the outer barrel assembly to rotate freely relative to the inner barrel assembly. If differential thermal expansion exists between the inner and outer bearing assemblies, the lower end of the inner barrel assembly (i.e., the core shoe) expands towards, or away from, the lower end of the outer barrel assembly (i.e., the bit body) longitudinally along the longitudinal axis 12 of the core barrel. Such differential thermal expansion may result in mechanical damage to components of a core barrel or lead to increased flow split, as noted above. The present invention solves this problem by positioning a swivel assembly proximate the core bit (i.e., a "near-bit" swivel assembly) and allowing the inner barrel assembly to thermally expand longitudinally upwards therefrom unimpeded. Employing a near-bit swivel assembly according to the present invention eliminates the conventional swivel assembly secured to the upper end of the inner barrel assembly and located proximate the upper end of the outer barrel assembly, thereby enabling the upper end of the inner barrel assembly to move freely within the outer barrel assembly.

Figure 13:
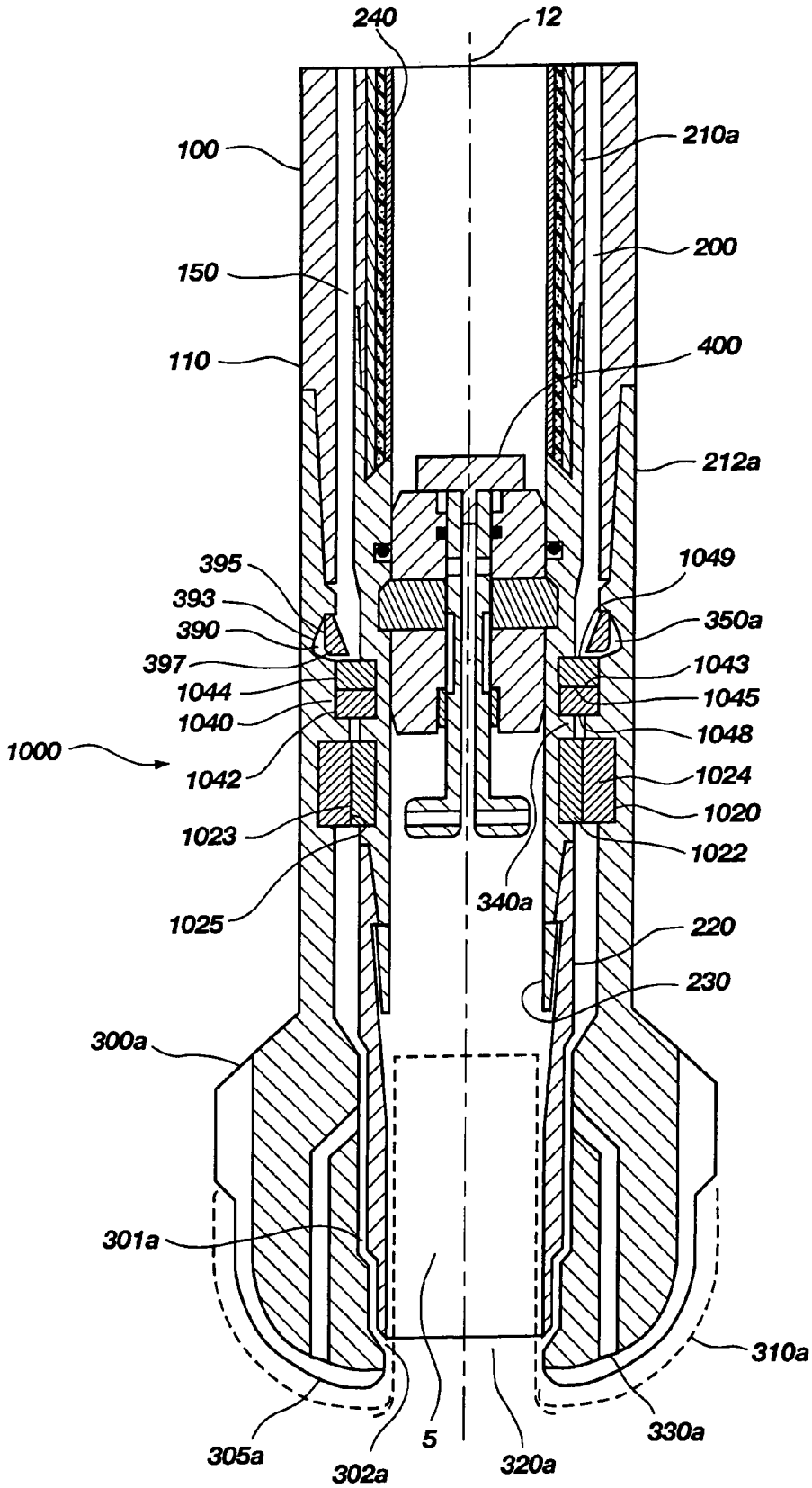
FIG. 13 shows a portion of the cross-sectional view of FIGS. 1A–1C, further including a near-bit swivel assembly according to the present invention.

Referring to FIG. 13, an exemplary embodiment of a near-bit swivel assembly 1000 according to the present invention is shown disposed proximate the lower end 212*a* of the lowermost inner tube section 210*a* adjacent a core bit 300*a*. The core bit 300*a* is essentially the same as the core bit 300 shown in FIGS. 1A–1C, and may include a plurality of cutters 310*a*, except that the core bit 300*a* is further configured for use with near-bit swivel assembly 1000, as will be described. The near-bit swivel assembly 1000 includes one or more bearing assemblies, such as, for example, a radial bearing assembly 1020 and a thrust, or axial, bearing assembly 1040. The radial bearing assembly 1020 maintains the inner barrel assembly 200 in the proper radial position and orientation relative to the outer barrel assembly 100, and the thrust bearing assembly 1040, in conjunction with a shoulder 340*a* and latch mechanism 350*a* disposed on the interior wall of the core bit 300*a*, as described below, maintains the inner barrel assembly 200 in the proper longitudinal position and orientation with respect to the outer barrel assembly 100. Also, the thrust bearing assembly 1040 bears the weight of the inner barrel assembly 200. The radial and thrust bearing assemblies 1020, 1040 cooperate to allow the outer barrel assembly 100 and core bit 300*a* to rotate freely with respect to the inner barrel assembly 200.

The radial bearing assembly 1020 generally comprises a journal—or sleeve-type bearing including a journal 1022 secured to the lower end 212*a* of the lowermost inner tube section 210*a* and a bushing 1024 secured to the wall of the core bit 300*a*. The bushing 1024 is configured to receive the journal 1022 upon insertion of the inner barrel assembly 200 into the outer barrel assembly 100, a bearing surface 1023 of journal 1022 contacting a bearing surface 1025 of bushing 1024. The journal 1022 and bushing 1024 may be constructed of any suitable materials known in the art. For example, at least a portion of the bearing surfaces 1023, 1025 of the journal 1022 and bushing 1024, respectively, may comprise tungsten carbide or diamond. During coring, the radial bearing assembly 1020 may be lubricated by drilling fluid flowing therethrough from annular region 150.

The thrust bearing assembly 1040 is secured to the lower end 212*a* of the lowermost inner tube section 210*a* and generally comprises a thrust plate 1042 and a mating bearing plate 1044. The thrust plate 1042 includes a bearing surface 1043 in contact with a bearing surface 1045 of the bearing plate 1044. The thrust plate 1042 and bearing plate 1044 may be constructed of any suitable materials known in the art. For example, at least a portion of the bearing surfaces 1043, 1045 of the thrust and bearing plates 1042, 1044, respectively, may comprise tungsten carbide or diamond. Drilling fluid flowing through the annular region 150 may lubricate the thrust bearing assembly 1040 during coring.

Although the radial and thrust bearing assemblies 1020, 1040 shown and described herein are of the sliding- or journal-type, those of ordinary skill in the art will understand that the radial and thrust bearing assemblies 1020, 1040 may be configured as any suitable type of bearing known in the art. For example, one or both of the radial and thrust bearing assemblies 1020, 1040 may be configured as a roller-type bearing. Also, a single bearing assembly providing both radial and longitudinal support may be used in lieu of the separate radial and thrust bearing assemblies 1020, 1040. Further, a near-bit swivel assembly 1000 (or the sponge core barrel assembly 10 generally) may include other bearing assemblies in addition to the radial and thrust bearing assemblies 1020, 1040 of the near-bit swivel assembly 1000 described herein. By way of example, one or more radial bearing assemblies may be disposed along the length of the inner barrel assembly 200 to provide further radial support therefor, so long as the additional bearing assemblies do not interfere with differential thermal expansion between the inner barrel assembly 200 and the outer barrel assembly 100.

An opposing lower surface 1048 of the thrust plate 1042 rests against a shoulder 340*a* provided on the interior wall of the core bit 300*a* to maintain the lower end of the inner barrel assembly 200 (i.e., the core shoe 220) at a desired longitudinal distance from the throat 320*a* of the core bit 300*a*. Also disposed on the interior wall of the core bit 300*a* are one or more latch mechanisms 350*a*. A latch mechanism 350*a* is configured to allow passage thereby of the core shoe 220 and the lower end 212*a* of the lowermost inner tube section 210*a* during insertion of the inner barrel assembly 200 into the outer barrel assembly 100, and is further configured—in conjunction with the shoulder 340*a*—to maintain the inner barrel assembly 200 in the proper longitudinal position within the outer barrel assembly 100. The latch mechanism 350*a* may be any suitable latching or locking mechanism known in the art capable of retaining the inner barrel assembly 200 in the proper longitudinal position.

By way of example, the latch mechanism 350*a* may comprise a retractable latch 390, as shown in FIG. 13. The retractable latch 390 includes a pawl 395 resiliently biased radially inward toward the longitudinal axis 12 and configured to retract within a cavity 393 in the interior wall of the core bit 300*a* during passage thereby of the core shoe 220 and the lower end 212*a* of the lowermost inner tube section 210*a*. The retractable latch 390 further includes at least one register surface 397 configured to contact, or at least lie in close proximity to, an opposing upper surface 1049 of the bearing plate 1044. When the inner barrel assembly 200 is fully inserted into the outer barrel assembly 100 and the lower surface 1048 of the thrust plate 1042 is abutting the shoulder 340*a* on the interior wall of the core bit 300*a*, the register surface 397 of the retractable latch 390 maintains the lower surface 1048 of the thrust plate 1042 in contact with, or at least in close proximity to, the shoulder 340*a*. Thus, the shoulder 340*a*, thrust bearing assembly 1040, and retractable latch 390, as well as any latch mechanism 350*a*, are cooperatively configured to maintain the inner barrel assembly 200 in a fixed vertical position relative to the outer barrel assembly 100 during coring.

The near-bit swivel assembly 1000 supports the inner barrel assembly 200 within the outer barrel assembly 100 and enables the outer barrel assembly 100 and core bit 300*a* to rotate freely relative to the inner barrel assembly 200. Because the near-bit swivel assembly 1000 is disposed at the core bit 300*a* and no other swivel assembly is necessary at an upper end of the inner barrel assembly 200, the upper end 214*c* of the uppermost inner tube section 210*c* is longitudinally floating within the outer barrel assembly 100. Accordingly, the upper end of the inner barrel assembly 200 is allowed to freely thermally expand through the outer barrel assembly 100 while the near-bit swivel assembly 1000 maintains the core shoe 220 and the lower end 212*a* of the lowermost inner tube section 210*a* at the correct vertical position relative to the throat 320*a* of the core bit 300*a*, thereby maintaining an annular gap 302*a* at a lower end of a narrow annulus 301*a* (see FIG. 13) at an optimum width and minimizing flow split.

The scope of the present invention also encompasses methods of performing sponge coring. Such a method may begin with assembly of the outer barrel assembly 100. A suitable-length outer barrel assembly 100 having a core bit 300 secured to a lower end thereof is rigged up and is suspended from the rig floor, either above or within the bore hole. The outer barrel assembly 100 may also include any one of a number of conventional core barrel components as is necessary, including a safety joint, one or more subs having a plurality of core barrel stabilizers, one or more outer tube subs having a plurality of wear ribs, or a drop ball and corresponding pressure relief plug.

One or more inner tube sections are then made-up to form the inner barrel assembly 200. By way of example only, the inner barrel assembly 200 may be comprised of three inner tube sections 210*a*, 210*b*, 210*c*, as shown and described with respect to FIGS. 1A–1C, 7, 8, 9, 10, and 11. Make up of the lowermost inner tube section 210*a* includes disposing a piston assembly 400 proximate the lower end 212*a* thereof. One or more locking elements 440 extending from the piston 410 of the piston assembly 400 engage the annular groove 217 in the wall of the lowermost inner tube section 210*a* to retain the piston assembly 400 therein. The piston assembly 400 is oriented such that the lower planar surface 434 of the piston rod 420 extending through the piston 410 is facing the throat 320 of the core bit 300. A core shoe 220 is secured to the lower end 212*a* of the lowermost inner tube section 210*a* and a core catcher 230 may also be disposed proximate the lower end 212*a* thereof.

One or more sponge liners 240 are then disposed within the lowermost inner tube section 210*a*. A single sponge liner 240 substantially equivalent in length to the length of the lowermost inner tube section 210*a*—which may be 30 feet, 45 feet, 60 feet, or any other suitable length—or, alternatively, a plurality of sponge liners 240 may be disposed within the lowermost inner tube section 210*a* and stacked end-to-end to fill substantially the entire length of the lowermost inner tube section 210*a*.

A gap 250*a* may exist between the top end of the sponge liner 240 (or the top end of the uppermost sponge liner 240, if more than one) and a shoulder 728 provided by the lower end of the valve assembly 700 (or a shoulder 928 provided by the lower end of the valve assembly 900) that is to be secured to the upper end 214*a* of the lowermost inner tube section 210*a*, as will be explained below. The downhole temperature will likely be significantly higher than the ambient temperature at the surface; therefore, differential thermal expansion between the sleeve 242 of the sponge liner or liners 240 and the lowermost inner tube section 210*a* will cause the gap 250*a* to narrow. One or more shims 50 may then be disposed within the lowermost inner tube section 210*a* on top of the sponge liner or liners 240 to fill the remainder of the gap 250*a*, the specific number of shims 50 being a function of the expected downhole temperature and the materials used to construct the lowermost inner tube section 210*a* and the sleeve 242 of the sponge liner or liners 240.

In an alternative embodiment, the lowermost inner tube section 210*a* and the sleeve 242 of the sponge liner or liners 240 disposed therein are constructed of the same material or of materials exhibiting similar rates of thermal expansion. Differential thermal expansion between the lowermost inner tube section 210*a* and the sponge liner or liners 240 is, therefore, eliminated or substantially reduced. Any gap 250*a* existing between the top end of the sponge liner 240 (or the top end of the uppermost sponge liner 240, if more than one) and the shoulder 728 provided by the lower end of the valve assembly 700 (or the shoulder 928 provided by the lower end of the valve assembly 900) is simply filled with the appropriate number of shims 50.

The lower seal assembly 720 of a valve assembly 700 (or the lower seal assembly 920 of a valve assembly 900) is then secured, as by threads, to the upper end 214*a* of the lowermost inner tube section 210*a*. The lower seal assembly 720 includes a sealing element 724, which may comprise a generally planar diaphragm 725, as shown in FIGS. 1A–1C and 9, a dome-shaped diaphragm, a ball valve, a releasable piston, or any other suitable sealing element as known in the art. Thus, a sealed chamber 216*a* is created within the lowermost inner tube section 210*a*, the piston assembly 400 forming a fluid seal proximate its lower end 212*a* and the lower seal assembly 720 of valve assembly 700 (or lower seal assembly 920 of valve assembly 900) forming a fluid seal proximate its upper end 214*a*. Presaturation fluid may then be introduced into the chamber 216*a* to protect the sponge liner or liners 240 from drilling fluid contamination prior to commencement of coring and from being compressed as a result of high downhole pressure.

Make up of the intermediate inner tube section 210*b* includes securing, as by threads, the upper seal assembly 740 of the valve assembly 700 (or the upper seal assembly 940 of the valve assembly 900) to the lower end 212*b* of the intermediate inner tube section 210*b*. The upper seal assembly 740 includes a sealing element 744, which may comprise a ball valve 745, as shown in FIG. 9, a generally planar diaphragm, a dome-shaped diaphragm, a releasable piston, or any other suitable sealing element as known in the art.

One or more sponge liners 240 are then disposed within the intermediate inner tube section 210*b*. A single sponge liner 240 substantially equivalent in length to the length of the intermediate inner tube section 210*b*—which, again, may be 30 feet, 45 feet, 60 feet, or any other suitable length—or, alternatively, a plurality of sponge liners 240 may be disposed within the intermediate inner tube section 210*b* and stacked end-to-end to fill substantially the entire length of the intermediate inner tube section 210*b*.

A gap 250*b* may exist between the top end of the sponge liner 240 (or the top end of the uppermost sponge liner 240, if more than one) and a shoulder 828 provided by the lower end of the valve assembly 800 that is to be secured to the upper end 214*b* of the intermediate inner tube section 210*b*, as will be explained below. As previously suggested, the downhole temperature will likely be significantly higher than the ambient temperature at the surface; therefore, differential thermal expansion between the sleeve 242 of the sponge liner or liners 240 and the intermediate inner tube section 210*b* will cause the gap 250*b* to narrow. One or more shims 50 may then be disposed within the intermediate inner tube section 210*b* on top of the sponge liner or liners 240 to fill the remainder of the gap 250*b*, the specific number of shims 50 being a function of the expected downhole temperature and the materials used to construct the intermediate inner tube section 210*b* and the sleeve 242 of the sponge liner or liners 240.

In an alternative embodiment, the intermediate inner tube section 210*b* and the sleeve 242 of the sponge liner or liners 240 disposed therein are constructed of the same material or of materials exhibiting similar rates of thermal expansion. Differential thermal expansion between the intermediate inner tube section 210*b* and the sponge liner or liners 240 is, therefore, eliminated or substantially reduced. Any gap 250*b* existing between the top end of the sponge liner 240 (or the top end of the uppermost sponge liner 240, if more than one) and the shoulder 828 provided by the lower end of the valve assembly 800 is simply filled with the appropriate number of shims 50.

The lower seal assembly 820 of the valve assembly 800 is then secured, as by threads, to the upper end 214*b* of the intermediate inner tube section 210*b*. The lower seal assembly 820 includes a sealing element 824, which may comprise a dome-shaped diaphragm 825, as shown in FIG. 10, a generally planar diaphragm, a ball valve, a releasable piston, or any other suitable sealing element as known in the art. Thus, a sealed chamber 216*b* is created within the intermediate inner tube section 210*b*, the upper seal assembly 740 of valve assembly 700 (or upper seal assembly 940 of valve assembly 900) forming a fluid seal proximate its lower end 212*b* and the lower seal assembly 820 of valve assembly 800 forming a fluid seal proximate its upper end 214*b*. Presaturation fluid may then be introduced into the chamber 216*b* to protect the sponge liner or liners 240.

Make up of the uppermost inner tube section 210*c* includes securing, as by threads, the upper seal assembly 840 of the valve assembly 800 to the lower end 212*c* of the uppermost inner tube section 210*c*. The upper seal assembly 840 includes a sealing element 844, which may comprise a dome-shaped diaphragm 845, as shown in FIG. 10, a generally planar diaphragm, a ball valve, a releasable piston, or any other suitable sealing element as known in the art.

One or more sponge liners 240 are then disposed within the uppermost inner tube section 210*c*. A single sponge liner 240 substantially equivalent in length to the length of the uppermost inner tube section 210*c*, or, alternatively, a plurality of sponge liners 240 may be disposed within the uppermost inner tube section 210*c* and stacked end-to-end to fill substantially the entire length of the uppermost inner tube section 210*c*.

The adjusting sleeve 610 of thermal compensation mechanism 600 and attached pressure compensation mechanism 500 are then disposed in the uppermost inner tube section 210*c*. The lower bearing surface 615 of the flange 614 at the lower end 613 of the tubular body 611 of the adjusting sleeve 610 abuts the top end of the sponge liner 240 (or the top end of the uppermost sponge liner 240, if more than one) disposed in the uppermost inner tube section 210*c*, and the outer bearing surface 617 of the flange 614 is in sliding contact with the interior wall of the uppermost inner tube section 210*c*.

The upper bearing surface 616 of the flange 614 on the adjusting sleeve 610 faces towards a shoulder 211*c* provided on the interior wall of the uppermost inner tube section 210*c*. A gap 250*c* may exist between the upper bearing surface 616 and the shoulder 211*c*. As set forth above, the downhole temperature will likely be significantly higher than the ambient temperature at the surface; therefore, differential thermal expansion between the sleeve 242 of the sponge liner or liners 240 and the uppermost inner tube section 210*c* will cause the gap 250*c* to narrow. One or more shims 50 may then be disposed within the uppermost inner tube section 210*c* on top of the upper bearing surface 616 of the flange 614 of the adjusting sleeve 610 to fill the remainder of the gap 250*c*, the specific number of shims 50 being a function of the expected downhole temperature and the materials used to construct the uppermost inner tube section 210*c* and the sleeve 242 of the sponge liner or liners 240 disposed therein.

It should be noted that make up of the uppermost inner tube section 210*c*, especially insertion of the adjusting sleeve 610 and shims 50, may be facilitated by a connection joint proximate the upper end 214*c* of the uppermost inner tube section 210*c*. A portion of the upper end 214*c* of the uppermost inner tube section 210*c* may then be a separately attached tube section, the lower end 212*c* of which may provide the shoulder 211*c*. Although considered herein as simply a portion of the uppermost inner tube section 210*c*, this separately attached tube section is, as was suggested above, commonly referred to as an upper connector sub.

A sealed chamber 216*c* is created within the uppermost inner tube section 210*c*, the upper seal assembly 840 of valve assembly 800 forming a fluid seal proximate its lower end 212*c* and the pressure compensation mechanism 500 attached to adjusting sleeve 610 forming a fluid seal proximate its upper end 214*c*. The pressure compensation mechanism 500 and adjusting sleeve 610 are retained in the upper end 214*c* of the uppermost inner tube section 210*c* by the engagement of the upper bearing surface 616 of flange 614 against the shoulder 211*c* of the uppermost inner tube section 210*c* or against the lowermost shim 50, if present. Presaturation fluid may then be introduced into the chamber 216*c* to protect the sponge liner or liners 240.

In an alternative embodiment, the uppermost inner tube section 210*c* and the sleeve 242 of the sponge liner or liners 240 disposed therein are constructed of the same material or of materials exhibiting similar rates of thermal expansion. Differential thermal expansion between the uppermost inner tube section 210*c* and the sponge liner or liners 240 is, therefore, eliminated or substantially reduced. In this embodiment, thermal compensation mechanism 600 with adjusting sleeve 610 is no longer necessary. Any gap 250*c* existing between the top end of the sponge liner 240 (or the top end of the uppermost sponge liner 240, if more than one) and the shoulder 211*c* extending from the interior wall of the uppermost inner tube section 210*c* is simply filled with the appropriate number of shims 50. The cylindrical housing 510 of pressure compensation mechanism 500 can be secured in the upper end 214*c* of the uppermost inner tube section 210*c* using a threaded connection, a retaining bolt, a retaining pin, a clamp, or any other suitable connecting element or method as known in the art.

With the lowermost inner tube section 210*a*, the intermediate inner tube section 210*b*, and the uppermost inner tube section 210*c* individually assembled, sealed, and filled with presaturation fluid, assembly of the inner barrel can proceed. As noted above, the outer barrel assembly 100 is rigged up and is hanging through the rig floor. The lowermost inner tube section 210*a* is lifted off the rig floor and lowered into the outer barrel assembly 100, a portion of the upper end 214*a* of the lowermost inner tube section 210*a* extending above the outer barrel assembly 100.

The intermediate inner tube section 210*b* is then lifted off the rig floor and is suspended above the lowermost inner tube section 210*a*, the lower end 212*b* of the intermediate inner tube section 210*b* facing towards the upper end 214*a* of the lowermost inner tube section 210*a*. The lower seal assembly 720 of valve assembly 700 (or lower seal assembly 920 of valve assembly 900), which was previously attached to the upper end 214*a* of the lowermost inner tube section 210*a*, is secured to the upper seal assembly 740 of valve assembly 700 (or upper seal assembly 940 of valve assembly 900), which was previously attached to the lower end 212*b* of the intermediate inner tube section 210*b*.

The valve assembly 700 (or valve assembly 900) is then actuated to join the chamber 216*a* within lowermost inner tube section 210*a* with the chamber 216*b* of intermediate inner tube section 210*b*. Actuation of the valve assembly 700 requires rupturing of the generally planar diaphragm 725 comprising the sealing element 724 of the lower seal assembly 720 and opening of the ball valve 745 comprising the sealing element 744 of the upper seal assembly 740. Again, rupturing of the planar diaphragm 725 may be performed by introducing presaturation fluid through a tap into the chamber 705 formed between the sealing elements 724, 744 to burst the diaphragm 725, by compression of fluid within the chamber 705 during interconnection of the lower and upper seal assemblies 720, 740, by a pressure differential created across the diaphragm 725 upon opening of the ball valve 745, or by a combination thereof.

If a releasable piston 925 and a generally planar diaphragm 945 are utilized in the lower and upper seal assemblies 920, 940 (see FIG. 11), respectively, actuation of the valve assembly 900 comprises rupturing of the planar diaphragm 945 followed by release of the releasable piston 925. The planar diaphragm 945 may be ruptured by the compression of fluid within the chamber 905 formed between the sealing elements 924, 944 during interconnection of the lower and upper seal assemblies 920, 940, by introducing presaturation fluid through a tap into the chamber 905 to burst the planar diaphragm 945, or by a combination thereof. The releasable piston 925 may be released by operation of the retaining element 960.

The lowermost inner tube section 210*a* and the intermediate inner tube section 210*b* secured thereto may then be lowered into the outer barrel assembly 100, a portion of the upper end 214*b* of the intermediate inner tube section 210*b* extending above the outer barrel assembly 100. The uppermost inner tube section 210*c* is then lifted off the rig floor and suspended above the intermediate inner tube section 210*b*, the lower end 212*c* of the uppermost inner tube section 210*c* facing towards the upper end 214*b* of the intermediate inner tube section 210*b*. The lower seal assembly 820 of valve assembly 800, which was previously attached to the upper end 214*b* of the intermediate inner tube section 210*b*, is secured to the upper seal assembly 840 of valve assembly 800, which was previously attached to the lower end 212*c* of the uppermost inner tube section 210*c*.

The valve assembly 800 is then actuated to join the chamber 216*c* within uppermost inner tube section 210*c* with the chambers 216*a*, 216*b* of the lowermost and intermediate inner tube sections 210*a*, 210*b*, respectively, which are already in fluid communication. Actuation of the valve assembly 800 requires rupturing of the dome-shaped diaphragms 825, 845 comprising sealing elements 824, 844 of the lower and upper seal assemblies 820, 840, respectively. Again, rupturing of the dome-shaped diaphragms 825, 845 may be performed by forces generated when the diaphragms come into mutual contact, by introducing presaturation fluid through a tap into the chamber 805 formed between the sealing elements 824, 844 to burst the dome-shaped diaphragms 825, 845, by compression of fluid within the chamber 805 during interconnection of the lower and upper seal assemblies 820, 840, or by a combination thereof.

The lowermost inner tube section 210*a*, the intermediate inner tube section 210*b*, and the uppermost inner tube section 210*c* are then lowered into the outer barrel assembly 100. The upper end 214*c* of the uppermost inner tube section 210*c* may be secured to the inner barrel assembly 200 by a conventional swivel assembly, suspending the interconnected inner tube sections 210*a*, 210*b*, 210*c* within the outer barrel assembly 100 and enabling the outer barrel assembly 100 to rotate freely relative to the inner tube sections 210*a*, 210*b*, 210*c*. The upper end 120 of the outer barrel assembly 100 can then be secured to a drill string for coring.

In an alternative embodiment, make up of the sponge core barrel assembly 10 proceeds as just described; however, the sleeves 242 of the sponge liner or liners 240 disposed within each inner tube section 210*a*, 210*b*, 210*c* are constructed of a material that is the same as, or exhibits similar thermal expansion characteristics as, the inner tube sections 210*a*, 210*b*, 210*c*. In another alternative embodiment according to the invention, make up of the sponge core barrel assembly 10 proceeds as described above but, rather than employing separate sponge liners 240 and inner tube sections 210*a*, 210*b*, 210*c*, one or more integrated sponge barrels 280 comprise the inner barrel assembly 200. In either of the above-described embodiments, differential thermal expansion between the inner tube sections 210*a*, 210*b*, 210*c* and the sponge liner or liners 240 disposed therein, respectfully, is substantially eliminated, and the thermal compensation mechanism 600 is no longer necessary. Accordingly, the pressure compensation mechanism 500 can be disposed directly in the upper end 214*c* of the uppermost inner tube section 210*c* and rigidly secured thereto by, for example, threads.

In another embodiment of a method for performing sponge coring according to the invention, the inner tube sections 210*a*, 210*b*, 210*c* are directly interconnected (see FIGS. 12A–12C) on the rig floor to form an inner barrel assembly 200 having a single, continuous fluid chamber 205 for receiving presaturation fluid, and the inner barrel assembly 200 is filled with presaturation fluid on the rig floor. In this embodiment, presaturation of the inner barrel assembly 200 may alternatively occur in a mouse hole. The presaturated inner barrel assembly 200 is then inserted into the outer barrel assembly 100, which is suspended through the floor of the drilling rig. Presaturation may also be done after the inner barrel assembly 200 is disposed in the outer barrel assembly 100.

Referring again to FIGS. 12A–12C, make up of the inner barrel assembly 200 may include disposing a piston assembly 400 proximate the lower end 212*a* of the lowermost inner tube section 210*a* and disposing a pressure compensation mechanism 500—and, if differential thermal expansion will occur, a thermal compensation mechanism 600—proximate the upper end 214*c* of the uppermost inner tube section 210*c*. Each of the inner tube sections 210*a*, 210*b*, 210*c* has one or more sponge liners 240 disposed therein, and shims 50 may be provided in the gaps 250*a*, 250*b*, 250*c*, respectively, as noted above. The sleeve 242 of the sponge liner or liners 240 disposed in each of the inner tube sections 210*a*, 210*b*, 210*c* and the inner tube sections 210*a*, 210*b*, 210*c* themselves may be constructed of materials exhibiting similar rates of thermal expansion or the same material. Alternatively, the inner tube sections 210*a*, 210*b*, 210*c* of FIGS. 12A–12C may comprise integrated sponge barrels 280 (see FIG. 5).

For any of the embodiments described in FIGS. 1A–1C, 7, 8, 9, 10, 11, and 12A–12C, the interconnected inner tube sections 210*a*, 210*b*, 210*c* comprise an inner barrel assembly 200 having a single, continuous interior chamber 205 for retaining presaturation fluid. The chamber 205, which is substantially lined with sponge material, can retain a single core sample having a length substantially equal to the sum of the individual lengths of the inner tube sections 210*a*, 210*b*, and 210*c*. Thus, by employing an inner barrel assembly 200 according to any embodiment of the present invention, sponge coring operations can be conducted with significantly fewer trip-outs of the drill string from the bore hole while, at the same time, obtaining a core sample having a length greater than the conventional 30-ft length.

In yet a further embodiment of the invention, make up of the sponge core barrel assembly 10 proceeds according to any of the embodiments set forth above; however, the conventional swivel assembly is eliminated and replaced with a near-bit swivel assembly 1000. The lowermost inner tube section 210*a* and core bit 300*a* are each configured to receive and cooperate with the near-bit swivel assembly 1000. During make up of the outer barrel assembly 100, the core bit 300*a*, having shoulder 340*a* and latch mechanism 350*a*, is fitted with, for example, the bushing 1024 of a radial bearing assembly 1020. If other alternative bearing configurations are used, make up of the outer barrel assembly 100 may not include insertion of a bearing assembly, or a portion thereof, into the core bit 300*a*. Similarly, the lower end 212*a* of the lowermost inner tube section 210*a* is fitted with, for example, the journal 1022 of a radial bearing assembly 1020 and a thrust bearing assembly 1040. Again, alternative bearing configurations may be employed.

When lowering the inner barrel assembly 200 into the outer barrel assembly 100, the latch mechanism 350*a* disposed on the wall of the core bit 300*a* (or, alternatively, on the interior wall of the lowermost inner tube section 210*a*) will allow passage thereby of the core shoe 220 and the lower end 212*a* of lowermost inner tube section 210*a*. For example, if the latch mechanism or mechanisms 350*a* comprise a retractable latch 390, as shown in FIG. 13, the pawl 395 will retract within the mating cavity 393 to allow passage of the inner barrel assembly 200. Lowering of the inner barrel assembly 200 continues until the journal 1022 of radial bearing assembly 1020 is aligned with the mating bushing 1024 and the lower surface 1048 of the thrust plate 1042 of thrust bearing assembly 1040 abuts the shoulder 340*a* extending from the wall of the core bit 300*a*.

With the inner barrel assembly 200 fully lowered into the outer barrel assembly 100 and the lower surface 1048 of the thrust plate 1042 of thrust bearing assembly 1040 resting against the shoulder 340*a*, the latch mechanism 350*a* and shoulder 340*a* cooperatively maintain the inner barrel assembly 200 in the proper longitudinal position and orientation along the longitudinal axis 12 of the core barrel assembly 10. For example, if the latch mechanism or mechanisms 350*a* comprise a retractable latch 390, at least one register surface 397 on the pawl 395 abuts, or is in close proximity to, the upper surface 1049 of the bearing plate 1044 of thrust bearing assembly 1040. Further, the radial bearing assembly 1020 maintains the proper radial position and orientation of the inner barrel assembly 200 relative to the outer barrel assembly 100.

The near-bit swivel assembly 1000 supports the inner barrel assembly 200, both longitudinally and radially, within and relative to the outer barrel assembly 100, while enabling the outer barrel assembly 100 to rotate freely with respect to the inner barrel assembly 200 disposed therewithin. Further, the near-bit swivel assembly 1000 maintains the core shoe 220 and the lower end 212*a* of the lowermost inner tube section 210*a* at the correct vertical position above the throat 320*a* of the core bit 300*a* while, simultaneously, allowing the upper end of the inner barrel assembly 200 (upper end 214*c* of uppermost inner tube section 210*c*) to freely thermally expand within the outer barrel assembly 100.

With the inner barrel assembly 200, having the single continuous chamber 205, disposed within the outer barrel assembly 100 to form a sponge core barrel assembly 10, sponge coring operations can be conducted. The sponge core barrel assembly 10 is lowered to the bottom of the bore hole, the drill string attached to the upper end 120 of the outer barrel assembly 100 extending to the surface. The appropriate rotational speed, ROP, and weight-on-bit ("WOB") are selected based on the type of the core bit 300 being used, the size and operational characteristics of sponge core barrel assembly 10, and the formation characteristics.

As noted above, the temperature at the bottom of the bore hole may be significantly higher than the ambient temperature at the surface where the inner barrel assembly 200 is made up. Thus, as the sponge core barrel assembly 10 descends into the bore hole, the inner and outer barrel assemblies 200, 100, as well as the presaturation fluid contained within the chamber 205, will expand due to the temperature increase. As a result, differential thermal expansion may occur within the inner barrel assembly 200 due to differences in thermal properties of the materials used to construct the various components of the inner barrel assembly 200. Also, thermal expansion of the presaturation fluid within chamber 205 may, if uncompensated for, cause the fluid pressure therein to increase significantly. Further, heat generated during the coring operation itself may lead to additional thermal expansion of the inner barrel assembly 200 and the presaturation fluid contained therein.

The sleeve 242 of the sponge liner or liners 240 disposed in each inner tube section 210*a*, 210*b*, 210*c* may be comprised of a material having a rate of thermal expansion substantially different than a rate of thermal expansion of the material used to construct the inner tube sections 210*a*, 210*b*, 210*c*. For example, the sleeve 242 may be constructed of aluminum, which has a coefficient of thermal expansion approximately twice that of steel, a material typically used to construct the inner tube sections 210*a*, 210*b*, 210*c*. A gap 250*a* formed between the top end of the sponge liner 240 (or the top end of the uppermost sponge liner 240, if more than one) disposed in the lowermost inner tube section 210*a* and a shoulder 728 (or 928) provided by the bottom end of the lower seal assembly 720 (or 920) of valve assembly 700 (or 900), as shown in FIGS. 1A–1C, 9, 10, and 11, or a shoulder 219*b* provided by the lower end 212*b* of the intermediate inner tube section 210*b*, as shown in FIG. 12B, will absorb any differential thermal expansion of the sponge liner or liners 240 disposed in the lowermost inner tube section 210*a*. One or more shims 50 may be disposed in the lowermost inner tube section 210*a* to take up any remainder of the gap 250*a* after full thermal expansion of the inner barrel assembly 200.

Similarly, a gap 250*b* formed between the top end of the sponge liner 240 (or the top end of the uppermost sponge liner 240, if more than one) disposed in the intermediate inner tube section 210*b* and a shoulder 828 provided by the bottom end of the lower seal assembly 820 of valve assembly 800, as shown in FIGS. 1A–1C, 9, 10, and 11, or a shoulder 219*c* provided by the lower end 212*c* of the uppermost inner tube section 210*c*, as shown in FIGS. 12B–12C, will absorb any differential thermal expansion of the sponge liner or liners 240 disposed in the intermediate inner tube section 210*b*. One or more shims 50 may be disposed in the intermediate inner tube section 210*b* to take up any remainder of the gap 250*b* after full thermal expansion.

A gap 250*c* formed between the upper bearing surface 616 of the flange 614 at the lower end 613 of tubular body 611 of the adjusting sleeve 610 of thermal compensation mechanism 600 and a shoulder 211*c* extending from the interior wall of the uppermost inner tube section 210*c* will absorb any differential thermal expansion of the sponge liner or liners 240 disposed in the uppermost inner tube section 210*c*. One or more shims 50 may be disposed between the upper bearing surface 616 of the adjusting sleeve 610 and the shoulder 211*c* of the uppermost inner tube section 210*c* to take up any remainder of the gap 250*c* after full thermal expansion.

During differential thermal expansion of the sponge liner or liners 240 disposed in the uppermost inner tube section 210*c*, the top end of the sponge liner 240 (or the top end of the uppermost sponge liner 240, if more than one) will exert an upwardly-directed force against the lower bearing surface 615 of the flange 614 extending from adjusting sleeve 610, causing the adjusting sleeve 610 to move longitudinally upwards along the longitudinal axis 12. This upward movement of the adjusting sleeve 610 likewise results in equivalent upward movement of the attached pressure compensation mechanism 500. Thus, the thermal compensation mechanism 600, via action of the adjusting sleeve 610, enables the volume of chamber 205 to increase as the downhole temperature increases. This increase in volume of the chamber 205 within inner barrel assembly 200 provides a greater overall volume within the chamber 205 for containing presaturation fluid. Accordingly, as the presaturation fluid thermally expands, the volume available for holding the presaturation fluid increases and prevents, or at least limits, the increase in fluid pressure within the chamber 205.

Additional pressure compensation is provided by the pressure compensation mechanism 500. The pressure relief element 520 or any other suitable pressure relief mechanism disposed in the cylindrical housing 510 of the pressure compensation mechanism 500 is configured to open when the fluid pressure within chamber 205 exceeds a selected threshold value and, subsequently, to close when the threshold pressure is restored. As the presaturation fluid thermally expands, the pressure compensation mechanism 500 continually maintains the fluid pressure within chamber 205 at or below the selected threshold pressure. Therefore, the pressure compensation mechanism 500 and the thermal compensation mechanism 600 cooperatively function together to maintain the presaturation fluid within chamber 205 at or below the threshold pressure and, hence, provide a pressure compensated inner barrel assembly 200.

In an alternative embodiment of the present invention, differential thermal expansion between the inner tube sections 210*a*, 210*b*, 210*c* and the sleeve 242 of the sponge liner or liners 240 disposed therein, respectfully, is substantially eliminated by constructing the inner tube sections 210*a*, 210*b*, 210*c* and the sleeve 242 of the sponge liner or liners 240 from the same material or from materials exhibiting similar thermal properties. In a further embodiment of the invention, such differential thermal expansion within the inner barrel assembly 200 is eliminated by make up of an inner barrel assembly 200 using one or more integrated sponge barrels 280 (see FIG. 5). An integrated sponge barrel 280 is essentially an inner tube section 282 having an interior cylindrical surface 283 onto which an annular layer of sponge material 281 is directly formed or attached. For either of the above-described embodiments in which differential thermal expansion within the inner barrel assembly 200 is eliminated or substantially reduced, the thermal compensation mechanism 600 including adjusting sleeve 610 is no longer necessary, and pressure compensation of the presaturation fluid contained within chamber 205 of the inner barrel assembly 200 is provided solely by the pressure compensation mechanism 500.

Once the sponge core barrel assembly 10 has reached the bottom of the bore hole, coring can begin. As the core sample 5 is cut and traverses the throat 320 of the core bit 300, the core shoe 220 (and core catcher 230, if used) guides the core sample 5 into the inner barrel assembly 200 and towards the piston assembly 400. The core sample 5 eventually reaches the lower planar surface 434 of the piston rod 420 extending through the piston 410 of the piston assembly 400, exerting an upwardly directed force against the lower planar surface 434. Further upward travel of the core sample 5 will move the piston rod 420 upwardly along the longitudinal axis 12. The low resistance to movement of the piston rod 420 through the bore 411 extending through the piston 410, in conjunction with the pressure compensation of the presaturation fluid within chamber 205 of the inner barrel assembly 200, enables the core sample 5 to move the piston rod 420 relative to the piston 410 with relatively little resistance. Structural damage to the core sample 5 is, therefore, minimized.

Continued upward travel of the core sample 5 will fully compress the piston rod 420, at which point the annular groove 425 in the piston rod 420 is in alignment with the locking element or elements 440 extending through the piston 410 and into the annular groove 217 in the wall of the inner barrel assembly 200. Also, when the piston rod 420 is fully compressed within the piston 410, the fluid passageway provided by the combination of ports 423, bore 422, and ports 432 enables the presaturation fluid contained within chamber 205 to escape the chamber 205 and flow around the core sample 5 and into the bore hole. As a result, fluid pressure acting against the piston assembly 400 is nonexistent, or at least substantially reduced. Further upward travel of the core sample 5 will initiate upward movement of the piston 410. Upward movement of the piston 410 will cause the outer end 442 of the locking element or elements 440 to disengage the annular groove 217, the annular groove 425 in the piston rod 420 providing a recess into which the inner end 444 of the locking element or elements 440 can travel. The piston assembly 400 is then free to move upwards with the core sample 5 as the core sample 5 traverses the inner barrel assembly 200.

A core sample 5 having a length substantially equal to the sum of the lengths of the inner tube sections 210*a*, 210*b*, 210*c*, as well as having high structural integrity, can then be cut. Tripping of the drill string from the bore hole will not be necessary prior to cutting the entire length of the core sample 5, which core sample length may comprise 45-ft, 60-ft, 90-ft, or a longer length, as desired. When coring is complete, the sponge core barrel assembly 10 can be tripped from the bore hole, the inner barrel assembly 200 removed from the outer barrel assembly 100, and the core sample 5 removed therefrom. The core sample 5 may be retained in the sponge liner or liners 240 for shipment and subsequent analysis and, if integrated sponge barrels 280 are employed, the core sample 5 may be contained directly in the integrated sponge barrels 280 for transportation. If a webbing layer 246, 286 is provided in the annular spongel layers 241, 281, friction between the core sample 5 and annular sponge layers 241, 281 can be significantly reduced and core integrity preserved.

In a further alternative embodiment of the present invention, coring operations are performed using a sponge core barrel assembly 10 including a near-bit swivel assembly 1000. Coring with a sponge core barrel assembly 10 including the near-bit swivel assembly 1000, proceeds as described above; however, the lower end of the inner barrel assembly 200 (lower end 212*a* of lowermost inner tube section 210*a*) is supported by the near-bit swivel assembly 1000 and the upper end of the inner barrel assembly 200 (upper end 214*c* of uppermost inner tube section 210*c*) is allowed to freely thermally expand upwards within the outer barrel assembly 100, thereby compensating for differential thermal expansion between the inner barrel assembly 200 and the outer barrel assembly 100. Coring with a near-bit swivel assembly 1000 may be desirable when the inner tube sections 210*a*, 210*b*, 210*c* or, alternatively, the integrated sponge barrels 280—comprising the inner barrel assembly 200 are comprised of aluminum, which thermally expands at approximately twice the rate of steel, which is the material typically used to construct the outer barrel assembly 100.

The many embodiments of a sponge core barrel assembly 10 according to the present invention having been herein described, those of ordinary skill in the art will appreciate the many advantages thereof. A robust sponge liner 240 according to the invention includes a sleeve 242 having one or more grooves formed therein for creating a high-strength bond between the sleeve 242 and an annular sponge layer 241, thereby inhibiting debonding of the annular sponge layer 241 from the sleeve 242 during coring. The sponge liner 240 may further include a layer of webbing 246 formed or molded into the annular sponge layer 241, adding additional structural strength to the annular sponge layer 241, preventing gouging of the annular sponge layer 241 by the core sample 5, inhibiting peeling of the annular sponge layer 241 from the sleeve 242, providing further mechanical support for the core sample 5 during transportation, and reducing friction between the core sample 5 and the annular sponge layer 241. Further, differential thermal expansion within the inner barrel assembly 200 may be eliminated by constructing the sleeve 242 of a sponge liner 240 and the inner tube sections 210*a*, 210*b*, 210*c* comprising the inner barrel assembly 200 from the same or similar materials. Also, differential thermal expansion can be eliminated using an integrated sponge barrel 280 according to the invention.

A novel valve assembly 700, 800, 900 having lower and upper seal assemblies 720, 740, 820, 840, 920, 940, respectively, enables the make up of a sponge-lined inner barrel assembly 200 comprised of multiple inner tube sections 210*a*, 210*b*, 210*c* that are separately presaturated and individually lifted from the rig floor to be subsequently joined in the outer barrel assembly 100. Once interconnected, the valve assembly or assemblies 700, 800, 900 enable the individually presaturated inner tube sections 210*a*, 210*b*, 210*c* to be joined, forming a single continuous chamber 205 within the inner barrel assembly 200 for containing presaturation fluid and for subsequently retaining the core sample 5. An inner barrel assembly 200 having a single continuous chamber 205 may also be formed according to the invention by directly interconnecting multiple inner tube sections 210*a*, 210*b*, 210*c* on the floor of the drilling rig and presaturating the entire inner barrel assembly 200 on the rig floor during a single presaturation operation. Thus, extended-length sponge cores 5 can be obtained with fewer trip-outs of the drill string from the bore hole.

A pressure compensation mechanism 500 and a thermal compensation mechanism 600, according to the invention, are cooperatively configured to provide a pressure compensated chamber 205 within the inner barrel assembly 200. The pressure compensated chamber 205 maintains the presaturation fluid disposed therein at or below a selected threshold pressure. Thus, the fluid pressure exerted against the piston assembly 400, or any other sealing mechanism disposed at the lower end 212*a* of the lowermost inner tube section 210*a*, is minimized, even for high downhole temperatures and pressures.

The piston assembly 400 maintains a positive seal at the lower end 212*a* of the lowermost inner tube section 210*a*, yet is configured to be easily displaced by the core sample 5 as the core sample 5 contacts the piston assembly 400. The incorporation of a piston rod 420 mechanically isolated from a piston 410 by one or more locking elements 440 minimizes the force necessary to dislodge the piston 410 from its seat and, accordingly, minimizes the corresponding forces exerted on the core sample 5. Also, the forces exerted on the core sample 5 by the piston assembly 400 are further limited by the pressure compensated inner barrel assembly 200.

A sponge core barrel assembly 10 according to the present invention may also include a near-bit swivel assembly 1000. The near-bit swivel assembly 1000 supports the lower end of the inner barrel assembly 200 proximate the core bit 300*a*, while enabling the outer barrel assembly 100 to rotate freely relative to the inner barrel assembly 200. The upper end of the inner barrel assembly 200 is, therefore, allowed to move freely within the outer barrel assembly 100, thereby compensating for differential thermal expansion between the inner and outer barrel assemblies 200, 100. Although the exemplary embodiment of a near-bit swivel assembly 1000 is shown and described herein in the context of a sponge core barrel and performing sponge coring operations, those of ordinary skill in the art will appreciate that a near-bit swivel assembly according to the present invention is generally applicable to all types of coring systems and methods of coring.

The foregoing detailed description and accompanying drawings are only illustrative and not restrictive. They have been provided primarily for a clear and comprehensive understanding of the present invention and no unnecessary limitations are to be understood therefrom. Numerous additions, deletions, and modifications to the above-described embodiments, as well as alternative arrangements, may be devised by those skilled in the art without departing from the spirit of the present invention and the scope of the appended claims.

What is claimed is:

1. A piston assembly for providing a fluid seal within an inner barrel assembly of a core barrel apparatus, the inner barrel assembly including an interior wall, the piston assembly comprising:

a piston configured to provide a fluid seal between an outer cylindrical surface of the piston and the interior wall of the inner barrel assembly;

at least one laterally movable locking element associated with the piston, the at least one laterally movable locking element configured to engage a cooperative structure of the interior wall of the inner barrel assembly when the at least one laterally movable locking element is at a first position and to disengage the cooperative structure when the at least one laterally movable locking element is at a second position; and a slidable piston rod associated with the piston, the slidable piston rod located and configured to maintain the at least one laterally movable locking element at the first position when the slidable piston rod is at one position, the slidable piston rod further configured for travel relative to the piston to another position where the at least one laterally movable locking element is free to move to the second position.

2. The piston assembly of claim 1, further comprising a disk-shaped portion on one end of the slidable piston rod, the disk-shaped portion having a substantially planar surface located and oriented for contacting a core entering the inner barrel assembly.

3. The piston assembly of claim 1, further comprising a fluid passageway configured to extend from a first end of the piston to a second opposing end of the piston when the slidable piston rod is at the another position.

4. The piston assembly of claim 3, wherein the fluid passageway comprises a bore extending through the slidable piston rod and at least one port extending through the slidable piston rod substantially transverse to the bore of the slidable piston rod and in fluid communication therewith.

5. The piston assembly of claim 4, further comprising:

a disk-shaped portion on one end of the slidable piston rod, the disk-shaped portion having a substantially planar surface located and oriented for contacting a core entering the inner barrel assembly; and at least one port extending through the disk-shaped portion substantially transverse to the bore of the slidable piston rod and in fluid communication therewith.

6. The piston assembly of claim 1, further comprising an O-ring type seal configured to provide the fluid seal between the outer cylindrical surface of the piston and the interior wall of the inner barrel assembly.

7. A pressure compensated inner barrel assembly for use in a core barrel apparatus, comprising:

an inner barrel assembly having an interior wall;

a sealing mechanism disposed within one end of the inner barrel assembly, the sealing mechanism including a passage extending between an upper end and a lower end and thereof and configured to provide a fluid seal between an exterior of the sealing mechanism and the interior wall of the inner barrel assembly;

a locking mechanism longitudinally securing the sealing mechanism within the inner barrel assembly and operable, responsive to contact with a core sample entering the inner barrel assembly, to release the sealing mechanism to slide longitudinally within the inner barrel assembly and to open the passage;

a pressure compensation mechanism disposed at an opposing, upper end of the inner barrel assembly above the sealing mechanism and configured to provide a fluid seal between the pressure compensation mechanism and the interior wall of the inner barrel assembly, a region within the interior wall of the inner barrel assembly between the sealing mechanism and the pressure compensation mechanism forming a chamber; and a pressure relief element disposed on the pressure compensation mechanism configured to maintain fluid contained within the chamber at or below a specified pressure.

8. The pressure compensated inner barrel assembly of claim 7, wherein the pressure relief element comprises a pressure relief valve configured to release a controlled volume of fluid from the chamber when fluid pressure within the chamber exceeds the specified pressure.

9. A pressure compensated inner barrel assembly for use in a core barrel apparatus, comprising:

an inner barrel assembly having an interior wall;

a sealing mechanism disposed at one end of the inner barrel assembly configured to provide a fluid seal between the sealing mechanism and the interior wall of the inner barrel assembly;

a pressure compensation mechanism disposed at an opposing end of the inner barrel assembly and configured to provide a fluid seal between the pressure compensation mechanism and the interior wall of the inner barrel assembly, a region within the interior wall of the inner barrel assembly between the sealing mechanism and the pressure compensation mechanism forming a chamber;

a pressure relief element disposed on the pressure compensation mechanism configured to maintain fluid contained within the chamber at or below a specified pressure; and a thermal compensation mechanism coupled to the pressure compensation mechanism and configured to move the pressure compensation mechanism through the inner barrel assembly in response to a change in temperature to expand a volume of the chamber.

10. The pressure compensated inner barrel assembly of claim 9, wherein:

the pressure compensation mechanism comprises a cylindrical housing having the pressure relief element disposed thereon, the cylindrical housing configured to provide a movable fluid seal between an outer surface of the cylindrical housing and the interior wall of the inner barrel assembly; and the thermal compensation mechanism comprises an adjusting sleeve slidably disposed in the inner barrel assembly, the adjusting sleeve having one end secured to the cylindrical housing of the pressure compensation mechanism and further including an opposing end configured to abut an end of a sponge liner disposed in the inner barrel assembly, the adjusting sleeve configured to move the cylindrical housing through the inner barrel assembly in response to thermal expansion of the sponge liner.

11. A pressure compensated inner barrel assembly for use in a core barrel apparatus, comprising:

an inner barrel assembly having an interior wall;

a sealing mechanism disposed at one end of the inner barrel assembly configured to provide a fluid seal between the sealing mechanism and the interior wall of the inner barrel assembly, wherein the sealing mechanism comprises:

a piston configured to provide a fluid seal between an outer cylindrical surface of the piston and the interior wall of the inner barrel assembly;

at least one laterally movable locking element associated with the piston, the at least one laterally movable locking element configured to engage a cooperative structure of the interior wall of the inner barrel assembly when the at least one laterally movable locking element is at a first position and to disengage the cooperative structure when the at least one laterally movable locking element is at a second position; and a slidable piston rod associated with the piston, the slidable piston rod located and configured to maintain the at least one laterally movable locking element at the first position when the slidable piston rod is at one position, the slidable piston rod further configured for travel relative to the slidable piston to another position where the at least one laterally movable locking element is free to move to the second position a pressure compensation mechanism disposed at an opposing end of the inner barrel assembly and configured to provide a fluid seal between the pressure compensation mechanism and the interior wall of the inner barrel assembly, a region within the interior wall of the inner barrel assembly between the sealing mechanism and the pressure compensation mechanism forming a chamber; and a pressure relief element disposed on the pressure compensation mechanism configured to maintain fluid contained within the chamber at or below a specified pressure.

12. A method of providing a fluid seal in an inner barrel assembly of a core barrel apparatus, comprising:

providing a fluid seal between an interior wall of the inner barrel assembly and an outer cylindrical surface of a piston disposed in the inner barrel assembly;

abutting a surface of a slidable piston rod associated with the piston against a laterally movable locking element associated with the piston to bias the laterally movable locking element against a cooperative structure of the interior wall of the inner barrel assembly to lock the piston at a fixed position within the inner barrel assembly; and moving the slidable piston rod relative to the piston in response to contact with a core sample to position the slidable piston rod at a location allowing the laterally movable locking element to move away from the cooperative structure to release the piston and enable the piston to travel freely within the inner barrel assembly.

13. The method of claim 12, further comprising providing a fluid passageway through at least one of the piston and the slidable piston rod when the slidable piston rod is at the location to enable fluid contained within the inner barrel assembly to flow out of the inner barrel assembly through the fluid passageway.

* * * * *

UNITED STATES PATENT AND TRADEMARK OFFICE

CERTIFICATE OF CORRECTION

PATENT NO. : 7,004,265 B2 
APPLICATION NO. : 11/057449
DATED : February 28, 2006
INVENTOR(S) : Luc Van Puymbroeck et al.

It is certified that error appears in the above-identified patent and that said Letters Patent is hereby corrected as shown below:

On the title page:
In the section: (56) References Cited,
U.S. PATENT DOCUMENTS:

| | | |
|---|---|---|
| Page 2, | 1ST COLUMN, 15th ENTRY, | change "5,546,798 A 8/1996 Colee et al." to --5,546,798 A 8/1996 Collee et al.-- |

In the specification:

| | | |
|---|---|---|
| COLUMN 16, | LINE 52, | change "sponge material" to --annular layer of sponge material **281**-- |
| COLUMN 16, | LINE 57, | change "sections and" to --sections **210***a*, **210***b*, **210***c*, and-- |
| COLUMN 21, | LINE 25, | change "O-ring or" to --O-ring type seal **470** or-- |
| COLUMN 23, | LINE 10, | change "assembly, one" to --assembly **10**, one-- |
| COLUMN 25, | LINE 61, | change "the piston is" to --the releasable piston **925** is-- |
| COLUMN 26, | LINE 4, | change "The diaphragm **725**" to --The planar diaphragm **725**-- |
| COLUMN 26, | LINE 58, | change "the diaphragm **725**" to --the planar diaphragm **725**-- |
| COLUMN 26, | LINE 59, | change "The diaphragm **725**" to --The planar diaphragm **725**-- |
| COLUMN 26, | LINE 66, | change "the diaphragm **725**." to --The planar diaphragm **725**.-- |
| COLUMN 27, | LINE 1, | change "the diaphragm **725**" to --the planar diaphragm **725**-- |
| COLUMN 27, | LINE 2, | change "the diaphragm **725**." to --the planar diaphragm **725**.-- |
| COLUMN 27, | LINE 40, | change "a tap (see" to --a tap **751** (see-- |
| COLUMN 27, | LINE 43, | change "releasable piston **925**." to --planar diaphragm **945**.-- |
| COLUMN 29, | LINE 59, | change "core shoe)" to --core shoe **220**)-- |

UNITED STATES PATENT AND TRADEMARK OFFICE

CERTIFICATE OF CORRECTION

PATENT NO. : 7,004,265 B2
APPLICATION NO. : 11/057449
DATED : February 28, 2006
INVENTOR(S) : Luc Van Puymbroeck et al.

It is certified that error appears in the above-identified patent and that said Letters Patent is hereby corrected as shown below:

In the claims:

CLAIM 11, COLUMN 46, LINE 6, change "the second position" to --the second position;--

Signed and Sealed this

Fourth Day of September, 2007

JON W. DUDAS
*Director of the United States Patent and Trademark Office*